United States Patent [19]

Zurilla et al.

[11] Patent Number: 4,713,121

[45] Date of Patent: Dec. 15, 1987

[54] ALKALINE RESISTANT PHOSPHATE CONVERSION COATINGS

[75] Inventors: Ronald W. Zurilla, Farmington Hills; John Huff, Detroit, both of Mich.

[73] Assignee: Parker Chemical Company, Madison Heights, Mich.

[21] Appl. No.: 5,180

[22] Filed: Jan. 20, 1987

Related U.S. Application Data

[60] Division of Ser. No. 735,286, May 16, 1985, Pat. No. 4,681,641, which is a continuation-in-part of Ser. No. 574,851, Jan. 6, 1984, abandoned.

[51] Int. Cl.[4] ..... C23C 2/06

[52] U.S. Cl. ..... 428/472.3; 148/6.15 Z; 106/14.12

[58] Field of Search ..... 148/6.15 Z, 31.5

[56] References Cited

U.S. PATENT DOCUMENTS 2,554,139 5/1951 Drysdale ..... 148/6.15

3,810,792 5/1974 Ries ..... 148/6.15 Z

*Primary Examiner*—Sam Silverberg

*Attorney, Agent, or Firm*—Lorraine S. Melotik; Roger L. May

[57] ABSTRACT

A method for increasing the resistance to alkaline dissolution of a phosphate conversion coating on a corrodible metal surface by an improved zinc phosphate conversion coating together with articles coated by this method are disclosed. The substrate is exposed to the phosphating solution by spraying or immersion to chemically effect a reaction with the substrate. First divalent metal cations are selected from magnesium and transition metals having a hydroxide with lower solubility in alkaline solution than zinc hydroxide. The other source of necessary metal cations is zinc and its cations are herein termed second divalent metal cations. In the preferred embodiment, the first divalent metal cations comprise about 84 to about 94 mole percent of the total first and second divalent metal cations in the bath. The deposited coating has first divalent metal cations (chemically combined with phosphate ions) present in an amount of at least 15 mole percent of the total first and second divalent metal cations in the coating.

13 Claims, 25 Drawing Figures

Fig. 15
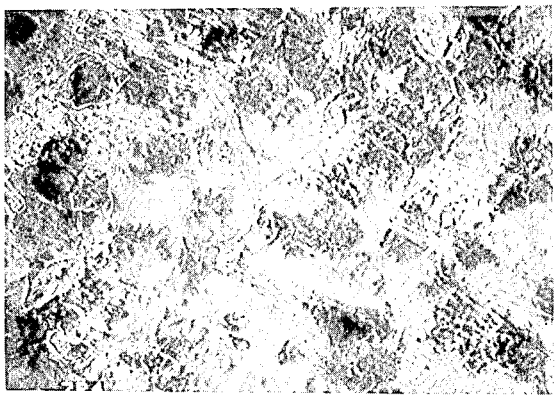
Fig. 16a Fig. 16c
AFTER
360 HOURS
AFTER
480 HOURS
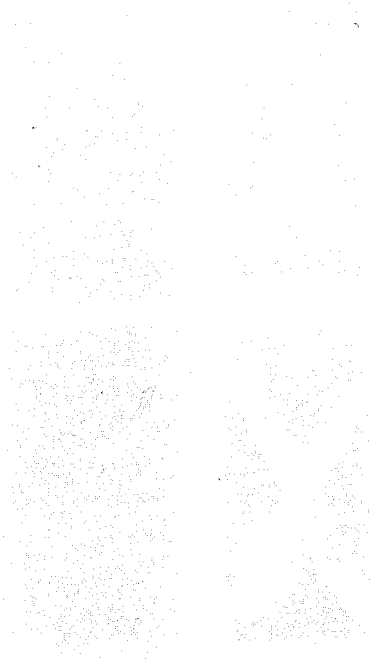
Fig. 16b Fig. 16d
90.7% 33.3
MOL PERCENT NICKEL
IN PHOSPHATING BATH

| Spectra | Mol % Nickel |
|---|---|
| A | 33.3 |
| B | 67.7 |
| C | 86.6 |
| D | 85.0 |
| E | 90.5 |
| F | 92.3 |

EXAMPLE 14
97.0 MOLE % NICKEL

SALT SPRAY 480 HRS.
Q STEEL

SALT SPRAY 288 HRS.
F4 STEEL

SALT SPRAY 480 HRS.
F4 STEEL

EXAMPLE 15

90.1 MOLE % NICKEL

SALT SPRAY 1440 HRS

Q STEEL

SALT SPRAY 1440 HRS

F6 STEEL

EXAMPLE 16
99.0 MOLE % NICKEL

SALT SPRAY 1440 HRS

Q STEEL

SALT SPRAY 1440 HRS

F6 STEEL

ALKALINE RESISTANT PHOSPHATE CONVERSION COATINGS

This is a division of application Ser. No. 735,286, filed May 16, 1985, now U.S. Pat. No. 4,681,641, which is a continuation-in-part of application Ser. No. 574,851, filed Jan. 6, 1984 and now abandoned.

TECHNICAL FIELD

Zinc phosphate conversion coatings are applied to metal substrates to provide a base for paint adhesion and to inhibit the undercutting of paint in a corrosive environment.

PRIOR ART STATEMENT AND BACKGROUND OF THE INVENTION

A. Prior Art

The use of phosphating compositions for inhibiting corrosion on metal substrates and improving the adhesion of superimposed organic coatings, such as paint, is an old and crowded art.

Phosphating compositions, typically applied by immersion of the product to be coated in a bath solution or by spraying, commonly have been used in the form of acidic, aqueous solutions typically containing phosphate ions, an oxidizing agent, and divalent, layer-forming metal cations. The layer-forming ions typically included zinc used alone or in combination with cations of barium, calcium, cobalt, manganese, magnesium, nickel, lithium, and other metals. The phosphate ions are commonly introduced by use of phosphoric acid. The oxidizing agents are commonly inorganic compounds, often consisting of the salt of one of the above-mentioned metals or of sodium or ammonia. Much of this art, as used today, has changed little over the years.

B. Specific Prior Art

Prior art utilizing both zinc cations and other divalent metal cations in the bath is illustrated by the following patents.

U.S. Pat. No. 3,810,792 to Ries teaches a process for applying phosphate coatings on steel, iron or zinc from an aqueous, acidic solution containing divalent, layer-forming metal cations, wherein 59 to 100 mole percent are nickel cations and the remaining 0 to 41 mole percent are cations other than nickel cations, e.g., zinc cations. This invention is exemplified in Example 1 with nickel cations comprising 100 mole percent of the divalent, layer-forming metal cations are in Examples 2, 3 and 4 with nickel cations comprising between 68 and 69 mole percent of the divalent, layer-forming cations.

U.S. Pat. No. 3,090,709 to J. A. Hendricks teaches a process for phosphate coating of metals with a view to forming an "amorphous coating." (See lines 29 and 38 of column 1; lines 11 and 14 of column 2; line 25 of column 3; line 32 of column 7, etc . . . ) His coatings are further "characterized by the substantial absence of crystalline structure" (column 1, lines 18–19), and one object is "inhibiting the formation of crystals (column 1, lines 32–33). He seeks a smoother base for paint, thereby enhancing its gloss. The amorphous type coating "is a mixed phosphate composed principally of zinc and one of the metals selected from . . . lithium, beryllium, magnesium, calcium, strontium, cadmium and barium" (column 2, lines 14–17). Hendricks states at line 65 of column 3 that "the chemical analysis of these amorphous type coatings reveals that they are mixed phosphates with the metal of the recited group occurring therein in the ratio of about one-half mole thereof to each mol of zinc." Hendricks further states at line 34 of column 5 that the amount of modifier metal must be adjusted so that lighter metals such as lithium and magnesium nitrates are added in greater quantities than the nitrates of the heavier elements such as barium. The minimum concentration for magnesium nitrate is given in the lower table in column 5 as 25.6 gr./liter or 10 mole percent in a solution containing 3.2 g/l zinc. Special coating conditions for an embodiment using magnesium are set forth in column 12 at lines 58–60, i.e., the reader is instructed to operate the process at room temperature and the immersion time kept below one minute.

U.S. Pat. No. 3,218,200 to J. A. Hendricks issued from a divisional application taken from the application upon which the aforedescribed U.S. Pat. No. 3,090,709 issued. Hence, it is essentially the same disclosure to be found in U.S. Pat. No. 3,090,709. There is an added paragraph in column 3, at lines 47–50, wherein the term "micro-crystalline" is used to characterize the coatings.

U.S. Pat. No. 4,231,812 to Paulus et al teaches a process for coating hot metal strips (above 250° C.) with a phosphate film by quenching the heated strips in a phosphating bath having a temperature of 80° C. or greater and containing one or more phosphates of the type Me $(H_2PO_4)_n$, wherein Me may be zinc, nickel, manganese, or alkali metal. No specific phosphating bath compositions are disclosed.

U.S. Pat. No. 4,053,328 to Oka et al teaches zinc phosphate solutions containing zinc ions in an amount, preferably, of at least 0.03 percent by weight and nickel ions in an amount of at least 0.01 percent by weight and in the nickel ion to zinc ion ratio of less than 1.89 to 1. This ratio may vary from 1.89:1 to 0.014:1.

U.S. Pat. No. 4,110,128 to Dreulle et al teaches a phosphate solution containing both zinc and nickel. In Table I, the zinc is present in an amount equivalent to 10 to 50 grams of anhydrous zinc chloride and 0.5 to 20 grams of hexahydrated nickel chloride per liter of final solution may be added. In Table II, 20 g. of anhydrous zinc chloride are used with 5 g. of crystallized hexahydrated nickel chloride.

U.S. Pat. No. 4,153,479 to Ayano et al teaches an acidic, oxidant-free zinc phosphate which contains nickel. They disclose in column 2 at line 17 that "The zinc ion should be present in an amount of higher than 0.01% by weight, generally from 0.01 to 0.2% by weight." They disclose in column 2, at line 66, that "the desired nickel ion concentration ranges from 0.01 to 0.2% by weight."

U.S. Pat. No. 3,723,334 to J. I. Maurer teaches a process for decreasing the scale formation in zinc phosphate composition by adding a carbohydrate. Phosphating compositions disclosed include 0.1–50 g/l zinc and may contain 0.001 to 0.4 wt.% nickel. In Example 3, the only example containing both zinc and nickel, the quantity of $Zn^{++}$ is given as 0.14 and the quantity of $Ni^{++}$ is given as 0.03. No unit of measurement is given for this example. Assuming that the unit either wt.% or g/l, the nickel component comprises less than 50 mol.% of the zinc/nickel component of the bath.

U.S. Pat. No. 2,554,139 to R. F. Drysdale teaches acidic phosphate compositions 2, 3, 4 or more cationic metals and is concerned with reducing the time of coating. In column 3, lines 1–7, they state that optimum results are obtained when zinc, cobalt and nickel are present in concentration of 0.048, 0.017 and 0.074 gm. per liter respectively. The concentrations in the phosphating bath are given as 0.00192, 0.00068 and 0.00296 gram per liter respectively. This is roughly equivalent to an atomic ratio of 3:2:6.

U.S. Pat. No. 4,182,637 to Otrhalek et al teaches a rinse step following a conventional phosphating treatment. A zinc phosphate solution is disclosed in Example 1 containing by weight 0.8% zinc ions, 2.4% phosphate ions, 0.07% nickel ions, 0.6% nitrate ions and 0.3% ferrous ions.

U.S. Pat. No. 4,265,677 to Muller et al relates to a special phosphating solution to be used prior to cathodic electropainting and is concerned with the ratio of zinc to fluoroborate. A zinc/nickel phosphate solution is disclosed in Example 1 which contains 0.69 g/l:Zn and 0.38 g/l:Ni.

U.S. Pat. No. 3,520,737 to Gerassinoff et al teaches a method for applying an aqueous acidic zinc phosphate solution which may contain such as a metallic catalyst nickel, cobalt, or copper in the form of soluble salts in small amounts such as 0.0025% nickel. Somewhat larger amounts of copper and/or nickel and/or cobalt. For heavier coating weights, they advocate use of these metals in amounts exceeding 0.001%. It is also disclosed that when these metals are present in greater amounts of 0.0055%–0.0165% autocatalytic nitrite-formation is promoted.

Oppen et al, U.S. Pat. No. 4,264,378, teaches a process for preparing metal surfaces with a phosphating liquid, containing at least one metal cation of valence two or greater (calcium, magnesium, barium, aluminum, zinc, cadmium, iron, nickel, cobalt and manganese), and contains at least one ion selected from molybdate, tungstate, nandate, niobate, and tantalate ions. In Example 5, Oppen et al discloses a bath containing 6.5 g/l zinc and 5.5 g/l nickel, i.e., the nickel component comprised less than 50 mol.% of the combined zinc-/nickel component of the bath. The use of this process for preparing surfaces of iron, zinc or aluminum, or their alloys, is disclosed, but the examples are limited to the coating of aluminum.

C. Increased Need for Greater Corrosion Protection

The need for phosphate coatings of consistently higher quality and much greater corrosion resistance has risen with the increase in the use of road deicing salts. The use of road salt in the snow belt areas of the United States and Canada has increased rapidly from about one million tons per year in the late 1950's to over 10 million tons per year at present.

For many years it was not understood why a scratch in the paint and phosphate film on the exterior of a car body produced corrosion failure over an area much greater than the width of the scratch itself. In a classic study by R. R. Wiggle, A. G. Smith and J. V. Petrocelli, published in *The Journal of Paint Technology* in 1968, they explained, in their paper entitled "Paint Adhesion Failure Mechanisms on Steel in Corrosive Environments," that alkaline dissolution of the phosphate film is the cause of undercutting of the paint film. The alkaline environment results from the cathodic reduction of oxygen to hydroxyl ions (forming alkali-sodium hydroxide). The appropriate reactions are explained in detail in FIGS. 1 and 2 of a paper entitled "Paint Failure, Steel Surface Quality and Accelerated Corrosion Testing" by V. Hospadaruk, J. Huff, R. W. Zurilla and H. T. Greenwood, published in *Society of Automotive Engineers Transactions,* Section 1, Volume 87, 1978.

Simply explained, the damaged or scratched paint area begins to rust where the paint is missing within the scratch. Iron oxide is formed from the base metal by an anodic reaction in an electrolyte of water and ions of sodium chloride. The dissolution of the iron to form ferrous ions ($Fe^{2+}$) is attended by the generation of electrons. Oxygen and water, which permeate the paint film in the region (which becomes cathodic) adjacent to the anodic area, then react to form hydroxyl ions. Accumulation of the hydroxyl ions results in the generation of liquid of very high basicity having a pH as high as 12.5 or more. Conventional zinc phosphate is soluble in this high basic liquid. Therefore, the paint is undercut, and a disbond between the paint film and the substrate (sheet steel) in the car body results. If the paint adjacent to the scratch is then removed, as by pulling a tape applied to the scratched area, the underlying steel surface is bright and shiny. This is due to the fact that the high pH liquid is an inhibitor for the formation of red rust. Of course, without taping, in actual use, the paint would have flaked off eventually where it has been undercut by alkaline dissolution of the phosphate film. The steel surface will then begin to rust by the mechanism common to rusting of bare steel.

D. Effect of Surface Carbon Contamination

Steel surface cleanliness, particularly contamination of automotive sheet steel by carbonaceous deposits, plays a major role in susceptibility to corrosion. The presence of even a very thin layer of carbon deposits on the steel as received from the steel mill is effective in preventing the formation of a phosphate conversion coating adequate for the best paint adhesion in the presence of an electrolyte which can support the cathodic reduction of oxygen to hydroxyl ions as described above. The reason for this is that the "pores" (either bare spots or very thin areas in the zinc phosphate conversion coating caused by the existence of carbon) act as reactive sites for initiation of the oxidation and reduction reactions. Convincing experimental evidence for this mechanism is given in the paper by R. W. Zurilla and V. Hospadaruk entitled "Quantitative Test for Zinc Phosphate Coating Quality" published in *Society of Automotive Engineers Transactions,* Section 1, Volume 87, 1978. This work was a breakthrough in the understanding of the parameters that control the quality of zinc phosphate coatings as a substrate for paint. This paper established that zinc phosphate coatings are porous and that a porosity of at least 1.0–1.5% is consistently encountered with substrates that have high surface carbon contamination. It is difficult to modify rolling mill practices to eliminate such surface carbon contamination, and thus deleterious porosity in phosphate films must be overcome. The porosity in such phosphate coatings is deleterious because it provides increased cathodicsites which support the electrochemical corrosion activity of the substrate. The phosphate film is then subjected to dissolution by the alkali (NaOH) generated.

E. Attempts to Reduce Corrosion Sensitivity

The main attempts by the prior art to reduce the corrosion sensitivity of phosphated metals have included (a) the introduction of inhibitors into the paint applied over the phosphate coatings to protect against corrosion, (b) the use of an inhibitor rinse such as chromic acid, which has been only partially successful in reducing the corrosion sensitivity, and (c) the use of finer phosphate crystal structure to provide a more uniform coating. These approaches have not significantly reduced the alkaline sensitivity of phosphate films.

F. Concepts Overlooked By The Prior Art

The prior art did not discover that the corrosion inhibiting property of a phosphating treatment employing zinc cations and other metal cations is critically dependent upon the relative concentrations of such cations in the bath, upon the relative concentrations of such cations in the deposited film, or upon the minimum concentration of zinc cations in a deposited coating containing cations of two or more metals.

SUMMARY OF THE INVENTION

This invention relates to a method for increasing the resistance to alkaline dissolution of a phosphate conversion coating on a corrodible metal substrate, thereby decreasing corrosion sensitivity, and to products of said method.

The coating is deposited by chemical reaction between the substrate and an acidic, aqueous solution containing two or more layer-forming, divalent metal cations and phosphate ions. As a result of this chemical reaction, iron cations will enter the film whenever the substrate to be coated is a ferrous metal. Cations from other contaminating sources also may enter the coating. All statements herein with respect to cation composition of a deposited phosphate coating will be made exclusive of iron and cation contaminating sources.

Layer-forming cations, other than zinc cations, used in the method of this invention, will be referred to as first divalent metal cations whether derived from a single metal or from a mixture of metals.

When layer-forming cations are limited to the cations of two divalent metals, the method is characterized by (a) selecting the first divalent metal cation from cations of magnesium, cations of transition metal having a hydroxide which has a lower solubility in an alkaline solution (NaOH) than zinc hydroxide and from a mixture of any of such cations; (b) selecting zinc cations as the second divalent metal cations; and (c) critically controlling within a narrow range the amount of first and second divalent metal cations present during the chemical reaction so that the deposited coating has a first divalent metal cation which comprises at least about 15.0 mole percent and not greater than about 43 mole percent of the total first and second divalent cations in the coating. Correspondingly, the zinc cations will comprise between about 57 and about 85 mole percent of the total first and second divalent cations of the coating.

The solubility of the hydroxides of the metal exemplified herein in a pH 12.50 NaOH solution in units of micromoles per liter are zinc 66.0, nickel 1.91, manganese 0.26, cobalt 0.25, and magnesium 0.009. These values were calculated from the solubility equations separately set forth for the different metals in "Atlas of Electrochemical Equilibrium in Aqueous Solutions" by M. Pourboix, 2nd edition, copyright 1974, published by National Association of Corrosion Engineers, Houston, Tex.

The property of magnesium or a transition metal having a hydroxide which has a lower solubility in an alkaline solution than zinc hydroxide is of importance in the corrosion resistance of the deposited coatings, i.e., its resistance to alkaline dissolution.

Divalent or trivalent lanthanides which will go into the aqueous, acidic solution in sufficient quantity or can be made to go into solution in sufficient quantity by means known in the art can be substituted for first divalent metal cations. Lanthanides are preferably employed in admixture with first divalent metal cations, e.g., nickel, magnesium, cobalt, and/or manganese cations, with a major amount of first divalent metal cations employed with a minor amount of lanthanide cations.

In the most preferred embodiment, the first divalent metal cations are nickel cations and are controlled to be about 84 to about 94 mole percent of the total zinc-/nickel divalent cations present in the coating bath. Zinc is preferably present in the solution in an amount of at least 0.2 g/l as $Zn^{+2}$ of said solution. The deposited coating will preferably be constituted of a nodular mixed-metal phosphate which we believe to contain $Zn_2Ni(PO_4)_2.4H_2O$, but with some nickel variation within a limited range.

In a second preferred embodiment, the first divalent metal cations are selected from cations of cobalt, cations of manganese, cations of magnesium, or mixtures of cations of two or more of nickel, cobalt, manganese, and magnesium. The deposited coating will be constituted of a mixed-metal phosphate of these and phosphate ions.

When the first divalent metal cations in the process of this invention are magnesium cations, their concentration in the coating bath is controlled to be about 84 to about 96, preferably 84 to 94 and most preferably 90 to 94, mole percent of the total zinc/magnesium divalent metal cations present in the coating bath.

When the first divalent metal cations in the process of this invention are manganese cations, their concentration in the coating bath is controlled to be about 45 to about 96, preferably about 84 to about 94 mole percent of the total zinc/manganese divalent metal cations present in the coating bath.

When the first divalent metal cations in the process of this invention are cobalt cations, their concentration in the coating bath is controlled to be about 65 to about 95, preferably about 75 to about 94 and most preferably about 84 to about 94, mole percent of the total zinc-/cobalt divalent metal cations present in the coating bath.

When two or more first divalent metal cations are used, relative concentrations can be determined from the concentration data herein disclosed and demonstrated for individual metals used in conjunction with the examples set forth herein for metal cation mixtures and routine experimentation.

The substrate is preferably exposed to the phospating solution for a sufficient time and at a sufficient temperature and pH (i.e. 30–120 seconds, 100°–140° F., 2.5–3.5 pH) to chemically react and deposit a coating of phosphate on the substrate, after which excess solution is removed from the coated substrate that has not been deposited as a coating. The mole ratio range of the first and second metal cations is most preferably in the range of about 5.2:1 to about 16:1.

The invention also comprehends a method for coating a phosphate film onto the surface of an alkali cleansed metal article by applying thereto a phosphate coating solution. The improvement is the deposition of a phosphate film having at least 15 mole percent (13.7% by weight) nickel, the film providing at least a substantial improvement in corrosion resistance for any metal article coated with known phosphate films and subsequently painted. For surface carbon-contaminated steel substrates, the improvement constitutes at least a doubling of corrosion resistance. The phosphate film results from the use of an acidic, aqueous coating solution havng an oxidizing agent content and a pH effective to chemically react with the article and a solution content consisting essentially of: (a) divalent, layer-forming metal cations consisting of 84–94 mole percent nickel of the metal cations, and zinc in an amount of at least 0.2 g/l of the solution as $Zn^{+2}$; and (b) phosphate ions in an amount at least sufficient to form dihydrogen phosphate with said metal cations. The article is comprised of a metal selected from the group comprising iron, aluminum, zinc and their respective alloys. This process is particularly advantageous when employed on steel articles which carry a total surface carbon content greater than 0.4 mg/ft$^2$.

In other embodiments, a portion of the phosphate anions needed to solubilize the first and second divalent metal cations may be other anions such as nitrates, sulfates and other anions known to those skilled in the art.

The phosphating solution preferably possesses a total acid content of 10–40 points, a free acid content of 0.5–2.0 points, and a total acid/free acid ratio of 10–60. The number of points of free acid is the number of ml of 0.1/N NaOH required to titrate a 10 ml sample to a brom phenol blue end point and the number of points of total acid is the number of ml of 0.1/N NaOH required to titrate a 10 ml sample to a phenolphthalein end point. When the process is applied to the coating of zinc metal articles or substrates, the solution preferably contains a fluoride selected from the group consisting of a simple fluoride, fluoroborate, fluorosilicate, or other complex fluoride. It is also preferable that the phosphate solution be maintained at a pH of 2.5–3.5 and contain oxidizing agents in sufficient amount. Oxidizing agents typically used in this art and which are suitable for use with this invention include, but are not limited to, nitrite, chlorate, nitrate, peroxide, aromatic nitro compounds, and combinations thereof. The preferred temperature is maintained at 100°–140° F. (38°–60° C.) during the phosphating contact. The exposure of the metal article to such solution should be preferably for a time of 30–120 seconds. In particular applications, higher and lower temperatures and much shorter and much longer exposure times may be preferred. It is desirable that the nitrite, used as an accelerator, be used in an amount of 0.5–2.5 points or 0.03–0.15 g/l of solution as $NaNO_2$. The number of points of nitride in the phosphate bath is the number of ml. of 0.042N $KM_nO_4$ required to titrate a 25 ml. sample to a permanent pink color.

It is advantageous to employ a concentrated phosphate solution to replenish the phosphate bath as it is used throughout a series of article coatings. The bath will become enriched with nickel, since more zinc than nickel is contained in the phosphate coating. The replenishment solution or concentrate should be formulated to maintain the nickel concentration of the bath in the preferred range of 85 to 94 mol percent of the total zinc/nickel divalent metal cations.

Alternatively, a portion of the nickel in the principal coating solution may be displaced by cations of one or more divalent, layer-forming metals selected from the group consisting of cobalt, manganese, and magnesium.

The product resulting from the practice of the above process is particularly characterized by a phosphate film in which the predominant structure is a mixed-metal phase phosphate where one of the metals is zinc and the other metal is magnesium and/or a transition metal having a hydroxide which has a lower solubility in an alkaline solution than zinc hydroxide. The film preferably has a nickel content of at least 15 mole percent and the mixed-metal phosphate is nickel/zinc phosphate in a nodular crystalline structure.

SUMMARY OF THE DRAWINGS

FIG. 15 is a scanning electron microscope photograph of a coating (at 1500×magnification) prepared in a phosphate bath containing in excess of 95 mole percent nickel.

FIG. 16 is a composite of photographs (FIGS. **16*a*–16*d***) of salt spray tested, taupe spray painted galvanized steel panels.

FIG. **19*a*–*c*** shows corrosion tested panels corresponding to a phosphating bath with a nickel content of 97.0 mole percent nickel.

Figure 20:
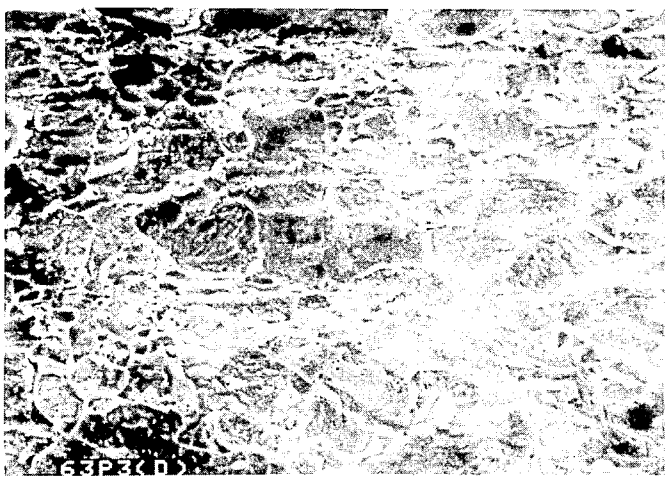

FIG. 20 is a scanning electron microscope photograph of a coating (at 1500×magnification) prepared in a phosphate bath containing 90.1 mole percent nickel.

Figure 21:
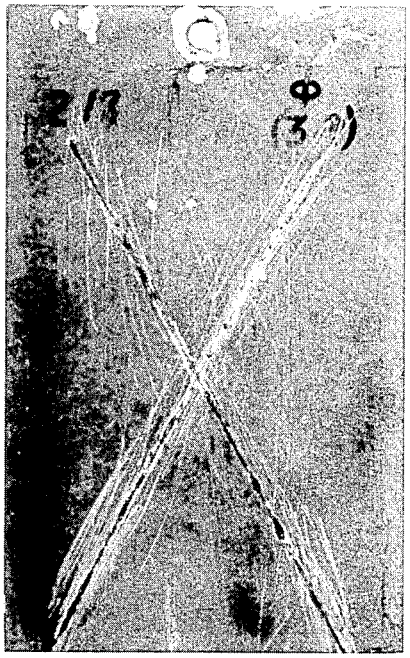
Figure 21:
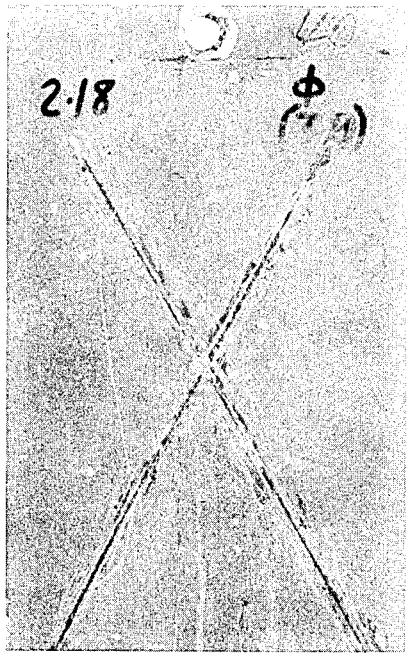

FIG. 21 shows corrosion tested panels corresponding to a phosphating bath with a nickel content of 90.1 mole percent nickel.

Figure 22:
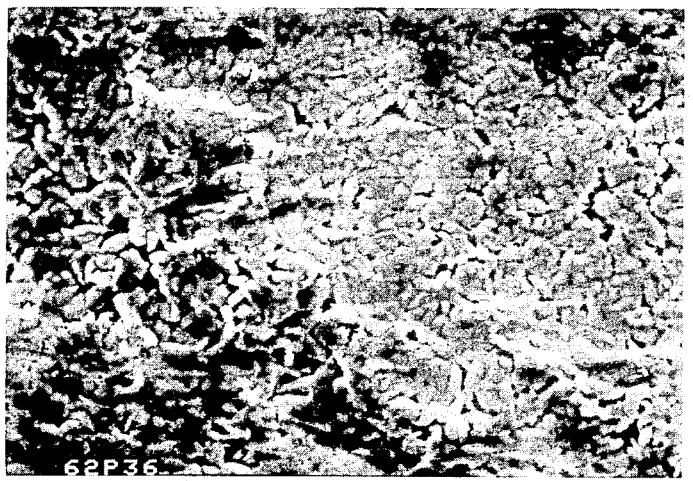

FIG. 22 is a scanning electron microscope photograph of a coating at 1500×magnification) prepared in a phosphate bath containing 99.0 mole percent nickel.

Figure 23:
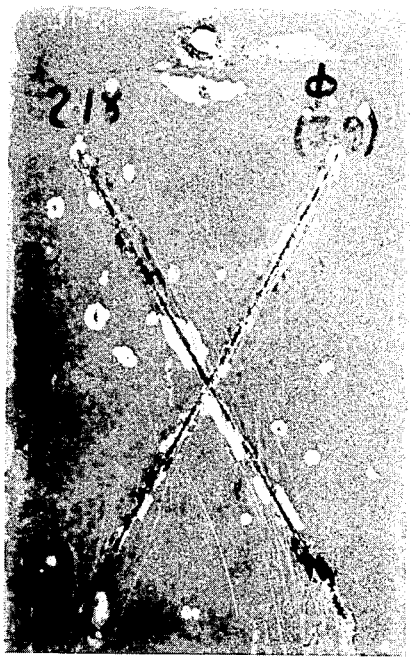
Figure 23:
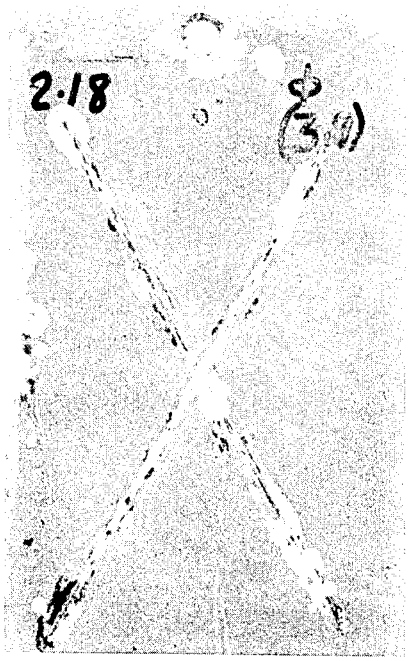

FIG. 23 shows corrosion tested panels corresponding to a phosphating bath with a nickel content of 99.0 mole percent nickel.

DETAILED DESCRIPTION

It is common practice in the automotive industry to apply an acidified zinc phosphate solution to metal car bodies and structural parts to form a zinc phosphate conversion coating on the metal surfaces. This is usually applied by spraying or dipping of the metal car bodies and parts. The phosphate coating has served to provide greater adherence of the paint system, applied thereover, which in turn has resulted in an improvement in resistance to corrosion. This invention provides a dramatic increase in resistance to alkaline dissolution which is exhibited by a quantum leap in the life of the coating system when subjected to accelerated salt spray corrosion tests.

Corrosion Reactions

Corrosion in an aqueous electrolyte is an electrochemical process involving oxidation and reduction reactions. The oxidation reaction is the anodic dissolution of steel or other metal substrate where ions leave the metal to form corrosion products. The excess electrons left in the metal by the oxidation reaction are consumed in the cathodic reduction reaction. A principal cathodic reaction is the reduction of dissolved oxygen to form hydroxide ions. Another cathodic reaction, which may occur in some cases, is the reduction of hydrogen ions. Both reduction reactions produce an increase in the electrolyte pH at the cathodic sites.

The anodic and cathodic reactions can occur at essentially similar atom sites. However, the reaction sites may become widely separated when differential oxygen or electrolyte concentration gradients are established. After a certain amount of rust is formed at the anodic sites, the cathodic reduction of oxygen for the most part is shifted to the periphery of the rust deposit or scratch, that is, to the zinc-phosphate-coating/steel interface. The anodic oxidation of iron is confined to the rust covered areas. A differential oxygen concentration cell is established due to the restricted transport of oxygen through the rust scale and the relatively easy accessibility of the adjacent rust-free steel surfaces to atmospheric oxygen. The important consequence of the differential oxygen concentration cell is the generation of a highly alkaline electrolyte at the phosphate/steel interface. The electrolyte pH can rise to above 12 in a sodium chloride environment, a condition prone to produce undercutting of the primer coating. The undercutting by the alkali sodium hydroxide is due principally to the dissolution of some of the zinc phosphate coating (and to a lesser extent the saponification of the reactive ester groups present in some primer resins).

When an undercut paint film is ruptured, the pH of the electrolyte will normally be lowered by dilution with water to more neutral values and the newly exposed metal will begin to corrode. Thus, cathodically induced adhesion failure of paints is an important precursor to the unrestricted corrosion of the metal. The degree of undercutting a primer coating undergoes in a corrosive environment is dependent on: the nature of imperfections in the paint coating (such as a scratch), the chemistry of the primer and the inhibitor used therein, the amount of contaminants present on the surface of the substrate prior to coating, and the effectiveness of the phosphate coating as a barrier to the lateral spread of the corrosion.

This invention has made the phosphate coating considerably more effective in spite of the first three factors.

Surface Carbon

Of these three factors, surface contamination is deserving of explanation because it has been one of the most serious obstacles to obtaining a consistent improvement in phosphate coatings. Carbonaceous residues on steel or other metallic substrates to be coated do have a deleterious effect on the corrosion protection afforded by paints and phosphate coatings. It has now been established by the prior art that there is a correlation between surface carbon contamination and salt spray performance. Carbon contamination can, by itself, produce early paint adhesion failure and subsequent corrosion problems. Carbonaceous deposits increase the apparent porosity of zinc phosphate coatings because they interfere with the phosphating reactions and subsequent deposition of the phosphate crystals. An increase in porosity permits a greater generation of hydroxyl ions by the cathodic reduction of oxygen at the electrochemically active pore sites. Apparent porosity levels of only a few percentage points can drastically reduce the effectiveness of phosphate coatings. Porosity levels of about 0.5% or less, associated with low surface carbon contamination, are required to inhibit the cathodic undercutting of the primer with conventional phosphate systems. What is needed is a phosphate coating which is relatively insensitive to alkaline undercutting, irrespective of carbon contamination. That is the purpose of this invention.

The research supporting this invention shows that a significant improvement in alkaline dissolution can be obtained with zinc phosphate coatings containing at least 15 mole percent nickel of the total Ni and Zn content, and a minimum level of about 57 mole percent zinc.

Preferred Process

A phosphate film is deposited onto the surface of an alkali-cleansed metal article or substrate by exposing the article or substrate to an acidic, aqueous phosphate solution for a sufficient time and at a sufficient temperature and pH to chemically react and deposit such film. The solution comprises first and second layer-forming, divalent metal cations, as aforedescribed, phosphate ions and an oxidizing agent. The amount of first and second divalent metal cations is controlled to provide a first divalent metal cation content in the resulting film of at least 15 mole percent of the total cations.

The phosphate film results from the use of an acidic, aqueous coating solution having an oxidizing agent and a solution pH effective to chemically react with the article or substrate. The solute content of the solution preferably contains (a) divalent, layer-forming metal cations consisting of 84–94 mole percent nickel of the total zinc/nickel metal cations and zinc in a minimum amount of about 0.2 g/l of said solution as $Zn^{+2}$; and (b) phosphate ions in an amount at least sufficient to form dihydrogen phosphate with said metal cations or, as aforedescribed other anions substituted for a portion of the phosphate ions. Alternatively, a portion of the nickel content may be substituted by use of a divalent, layer-forming metal cations selected from the group consisting of cobalt, magnesium and manganese.

More particularly, the metal article is cleansed by use of an alkaline cleaner containing a titanium conditioning compound at a temperature of 100°–140° F. The article is subjected to the alkaline cleaner for a period of about 30 to about 120 seconds and then rinsed with water at a temperature of about 100° to about 140° F. for a period of 30–120 seconds. Alternatively, one may use an alkaline cleaner followed by a water rinse which contains a titanium conditioning compound. The alkaline-cleansed metal substrate is then sprayed or immersed in a phosphate bath solution maintained at a temperature of about 100° to about 140° F. with a composition modified as specified above. The solution has a total acid content of 10–40 points, a free acid content of 0.5–2.0 points, and total acid/free acid ratio of 10–60. The pH is preferably maintained at 2.5–3.5 and nitrites are present in the bath in an amount of about 0.5 to about 2.5 points. Following such phosphating exposure, excess solution is removed from the article or substrate by a rinsing sequence consisting of a water rinse at ambient to about 100° F. for about 30 to about 120 seconds, an inhibitor rinse which contains a chromate or other dissolved corrosion inhibitor at ambient to about 120° F. for about 30 to about 60 seconds, and a deionized water rinse at ambient temperature for about 15 to about 30 seconds.

Phosphating Solution

Figure 17:
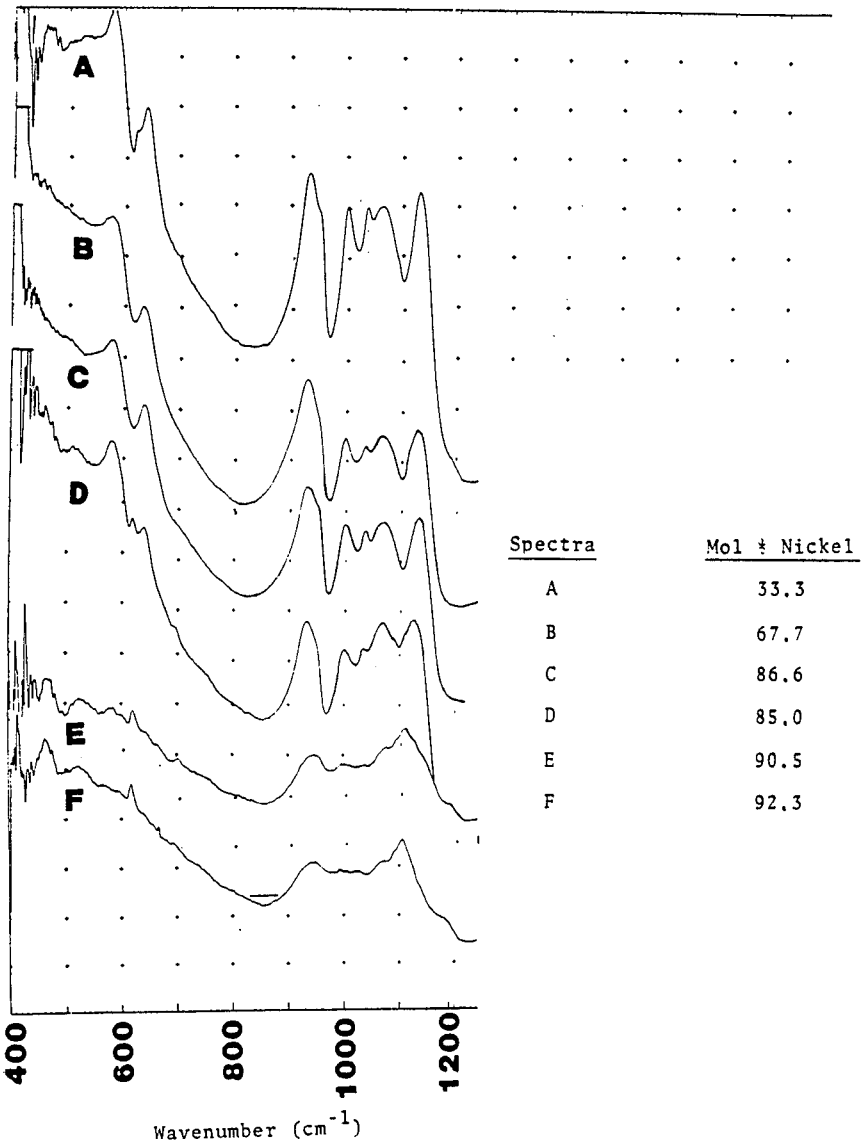
FIG. 17 is a graphical display of infrared spectra of phosphate coatings prepared in phosphate baths having various nickel contents.

The phosphating solution should contain nickel cations which constitute at least about 84 mole percent of combined metal cations (about 82.5% by weight) in the solution. However, it is important that the zinc cation of the phosphating solution be at least 0.2 g/l as $Zn^{+2}$ or 0.79 g/l as $Zn(H_2PO_4)_2$. The molar ratio of Ni/Zn is advisedly in the range of 5.2:1 to 16:1. Thus, for example, if zinc is 16 mole percent of the nickel/zinc cation content, there must also be at least 0.2 g/l as $Zn^{+2}$ in solution. The nickel content therefore must be at least 1.0 g/l of the bath solution (84 mole percent of the nickel/zinc total). This interrelationship between minimum zinc and high nickel content in the nickel embodiment is essential to producing the phenomenon of this invention, which is believed to lie in the formation of a mixed-metal phosphate structure containing zinc and either magnesium or a transition metal whose hydroxide has a lower solubility in an alkaline solution than iron or zinc hydroxide. As shown in FIG. 17, infrared spectra establish that the structure of phosphates formed from high nickel baths is different from those coatings formed from baths having less than about 84 mole percent nickel. The scanning electron microscope photographs further establish that there is an abrupt change in morphology for phosphates formed from baths having a nickel content above about 84 mole percent.

While the effective bath concentration range for magnesium cations is essentially the same as for nickel cations, a wider range, i.e., about 45 to about 96 mole percent, can be advantageously used with manganese cations and a wider range, i.e., about 65 to about 95 mole percent, can be advantageously used with cobalt cations but, with both manganese and cobalt, the range of about 84 to about 94 mole percent is preferred.

The initial phosphate solution may be conveniently prepared by making up a nickel and zinc phosphate solution concentrate from preferably the oxide or carbonate and phosphoric acid. Concentrates of zinc ions and concentrates of the first divalent metal ions may be prepared separately. Separate divalent metal cation concentrates preferably contain 100 to 150 g/l of the first divalent metal ions when the divalent metal is nickel or cobalt, 90 to 140 g/l when the divalent metal is manganese and 40 to 65 g/l when the divalent metal is magnesium. When a combined concentrate is prepared, one preferably adds 11 to 20 g/l of zinc ions to such separate concentrates. These metal phosphate concentrate solutions can be used to make up a fresh phosphate bath by using sufficient quantities of either, a combined concentrate or of each of such separate concentrated solutions with water to render the desired bath concentrations as described previously.

During use of the phosphating bath, the ratio of nickel to zinc will increase because more zinc than nickel is deposited in formation of the phosphate film. It is desirable to have a separate concentrate which is formulated for replenishment of the starting concentrations of zinc and nickel in the bath.

Substrate

The substrate is preferably selected from the group consisting of iron, aluminum, zinc and their respective alloys. When the substrate is either zinc or aluminum, the phosphate solution preferably additionally contains 0.1–4.0 g/l in some embodiments preferably, 0.1–1.0 g/l fluoride ion to enhance the formation of zinc phosphate coating.

Coated Product

Figure 1:
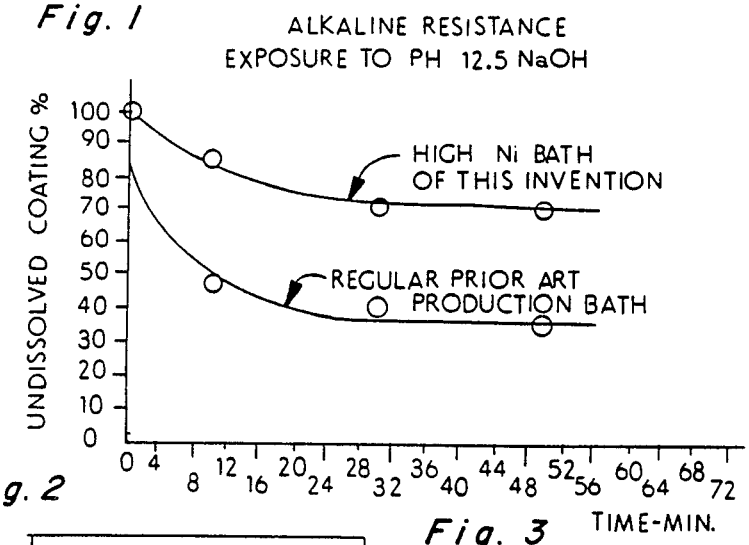
FIGS. 1–3 are graphical illustrations showing respectively: (1) alkaline sensitivity of coatings made by use of high and conventional nickel zinc phosphate baths, (2) nickel in the coating as a function of nickel in the bath, and (3) salt spray life as a function of nickel in the phosphate coating.
Figure 2:
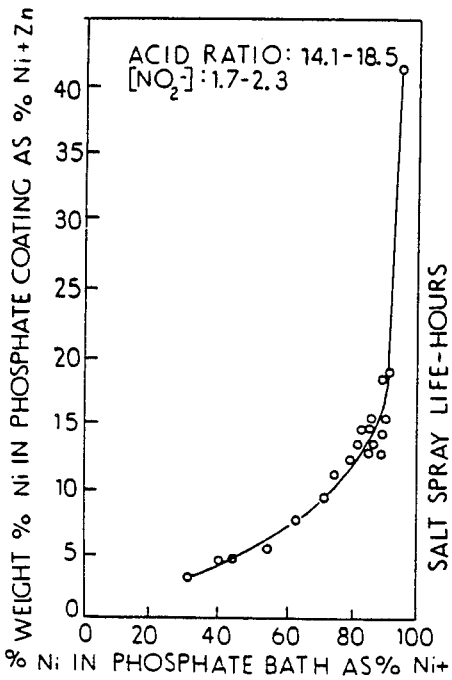
Figure 3:
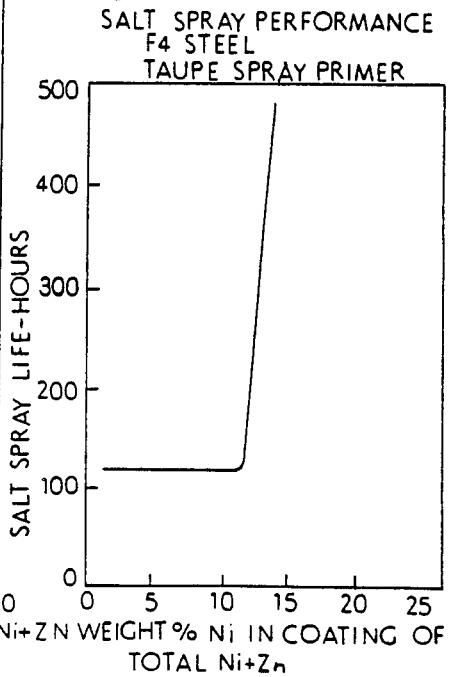

The resulting coated product is characterized by unusually good resistance to alkali dissolution (see FIG. 1 comparing several test panels of the prior art and this invention exposed to a 12.5 pH NaOH solution) and by its excellent chemical bonding to the substate. The zinc-/nickel phosphate conversion coating is the result of a chemical reaction with the substrate and has a nodular morphology (see FIGS. 10–13). The product of this invention is particularly characterized by a significantly improved salt spray performance showing little or no paint undercutting after 500 test hours abruptly occurring when the nickel content exceeds 15 mole percent (at about 13.7% by weight) in the coating (see FIG. 3). The amount of nickel in the coating at or above 13.7% by weight can easily be controlled by regulating the amount of nickel in the bath to exceed 2.5% of the weight of the Ni/Zn in the bath (see FIG. 2). The coating has high corrosion resistance even with surface carbon contamination levels greater than mg/ft$^2$. Also, for bimetal interfaces, e.g., steel/galvanized steel couple, the coatings of this invention have shown superior corrosion resistance.

EXAMPLES

A series of test panels for Examples 1–13 were prepared by cutting sheet metal into panels having a size of 4×12". The test panels were exposed to a phosphating solution of known chemistry (see Table I), rinsed and dried. A portion of selected panels was used for determination of coating weight, composition, morphology, and structure of the phosphate coating. The remaining portion from these panels was painted with taupe primer paint (epoxy ester-melamine resin primer). These samples, after baking, were then scribed in an "X" pattern to bare metal and then subjected to an accelerated salt spray test, after which the degree of paint undercutting was observed and/or measured. The salt spray test essentially involves exposing panels to a mist of a 5% sodium chloride solution in an enclosed chamber maintained at 35° C. in accordance with the ASTM B117 standard test method. In the following examples "conventional alkaline cleaning" means that the alkaline cleaner contains a titanium compound. The number of points of total alkali is the number of ml of 0.1/N HCl required to titrate a 10 ml sample of cleaner to a brom cresol green end point.

EXAMPLE 1

A phosphating bath solution was prepared having the following composition:

22.2 g/l $Zn(H_2PO_4)_2$
1.08 g/l $Ni(H_2PO_4)_2$
5.85 g/l $H_3PO_4$
0.13 g/l $NaNO_2$

As formulated, this bath had a total acid concentration of 11.3 points. The bath acidity was then adjusted by the addition of NaOH to a free acid concentration of 0.8 points, resulting in a total acid to free acid ratio of 14. In a bath of this composition, the dissolved nickel constitutes 33.3 mole percent of the dissolved divalent cations, which is typical of compositions currently used commercially in spray applied phosphating systems.

Steel panels of two types were selected for phosphating with the above phosphating composition. The first type, designated as Q steel, was a commercially available steel test panel having very low surface carbon contamination, typically in the range of less than 1 $mg/m^2$ (0.093 $mg/ft^2$). The second type of panel was cut from commercial auto body sheet, identified as F4. This steel was known to have surface carbon values in the range of 1.8 to 6.2 $mg/m^2$ (0.17 to 0.58 $mg/ft^2$), and to be subject to early salt spray failure in tests with spray paint primers applied over conventional zinc phosphate. Panels of Q steel and F4 steel were spray cleaned for two minutes with a conventional alkaline cleaner having a strength of 4.7 points and a temperature of 60° C. (140° F.), spray rinsed for 30 seconds with 60° C. tap water, and spray phosphated for two minutes with the above phosphate bath heated to 60° C. The panels were spray rinsed for one minute with 20° C. (68° F.) deionized water and dried in an oven at 82° C. (180° F.) for five minutes. None of the phosphated panels were post-treated with an inhibitor rinse.

Figure 5:
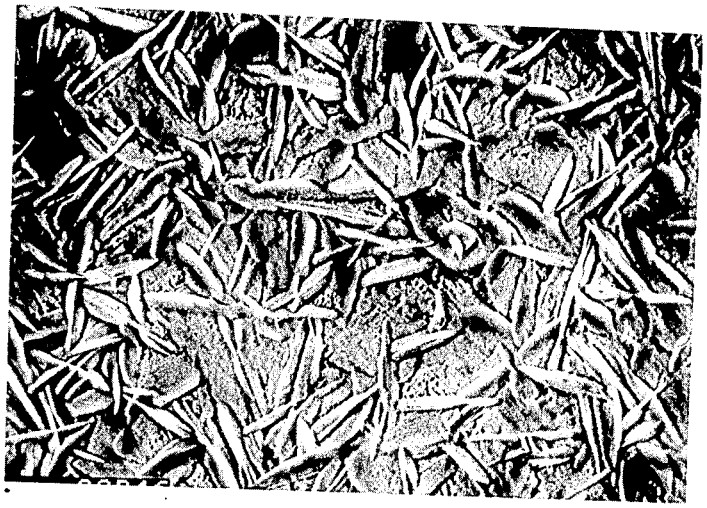
FIGS. 5–8 are scanning electron microscope photographs of the crystalline structure of coatings (at 1500×magnification) corresponding to panel photographs **4*a*, 4*c*, 4*e* and 9*c***, respectively.

The steel panels that were phosphate coated by this procedure had a uniform, gray appearance and a coating weight of about 1.62 $g/m^2$ (150 $mg/ft^2$). Chemical analysis showed that the nickel content of the phosphate coatings was equal to 3.2% by weight of the total nickel and zinc content of the coating on both the Q and F4 steels. This is equivalent to 3.5 mole percent Ni. A scanning electron microscope photograph of the phosphate coating on the Q steel, taken at 1500× magnification, is shown in FIG. 5. This structure is typical of the morphology of spray applied commercial zinc phosphate coatings.

The phosphate coated Q and F4 steel panels were spray painted with an epoxy ester-melamine resin based primer. After baking, the paint thickness was approximately 23 micrometers. Salt spray testing of the painted and scribed panels was carried out in accordance with the ASTM B117 standard. The specification for the epoxy ester-melamine resin based primer employed in these tests stipulates that 3 mm undercutting of the paint from the scribe line on the tested panels, as determined by taping the entire surface of the panel, constitutes failure.

Figures 4A, 4B, 4C, 4D, 4E, 4F, 4G, 4H:
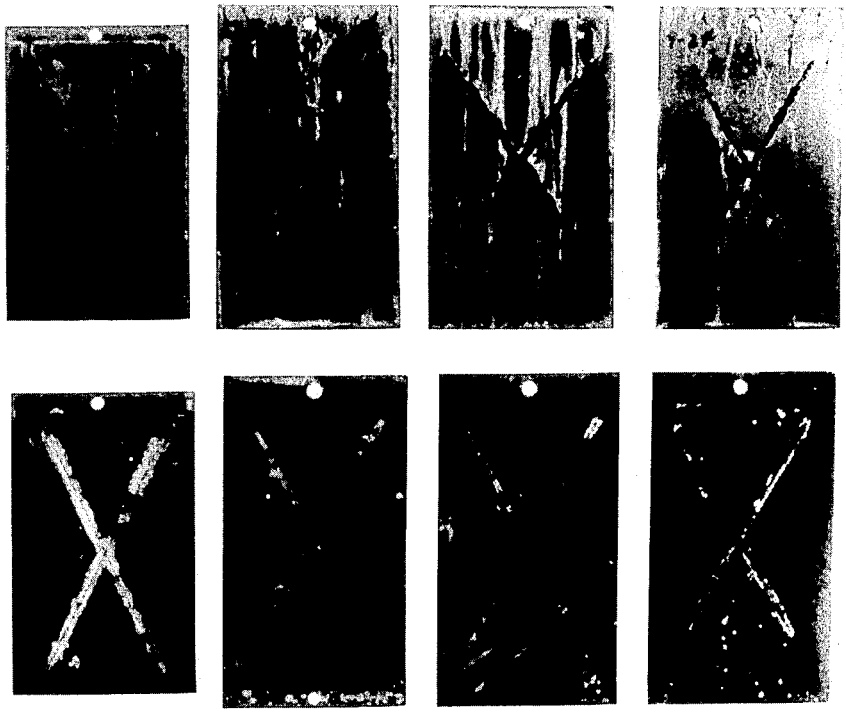
FIG. 4 is a composite of photographs (**4*a* through 4*h***) showing taupe spray painted steel panels, each scratched and subjected to salt spray corrosion tests, the panels having varying surface cleanliness, and having been phosphated with a variable nickel content in the bath, in the range of 33–77 mole percent, and variable zinc content.

Salt spray testing of the test panels designated Q was discontinued after 480 hours with essentially zero undercutting from the scribe line (see FIG. 4*a*). The test panels designated F4, on the other hand, failed within 96 hours of salt spray testing (see FIG. 4*b*).

EXAMPLE 2

A phosphating bath solution was prepared having the following composition:

4.44 g/l $Zn(H_2PO_4)_2$
5.94 g/l $Ni(H_2PO_4)_2$
3.36 g/l $H_3PO_4$
0.12 g/l $NaNO_2$

As formulated, this bath had a total acid concentration of 14.7 points. The bath acidity was then adjusted by the addition of NaOH to a free acid concentration of 0.9 points, resulting in a total acid to free acid ratio of 16. In a bath of this composition, the dissolved nickel constitutes 57.9 mole percent of the dissolved divalent cations.

Panels of the two steels designated Q and F4, described in Example 1, were spray cleaned and rinsed as detailed in Example 1. After the rinsing step, they were spray phosphated for two minutes with the above phosphate bath heated to 60° C. The panels were then spray rinsed with 20° C. deionized water and dried in an oven at 82° C. for five minutes. As in Example 1, none of the phosphated panels were post-treated with an inhibitor rinse.

Figure 6:
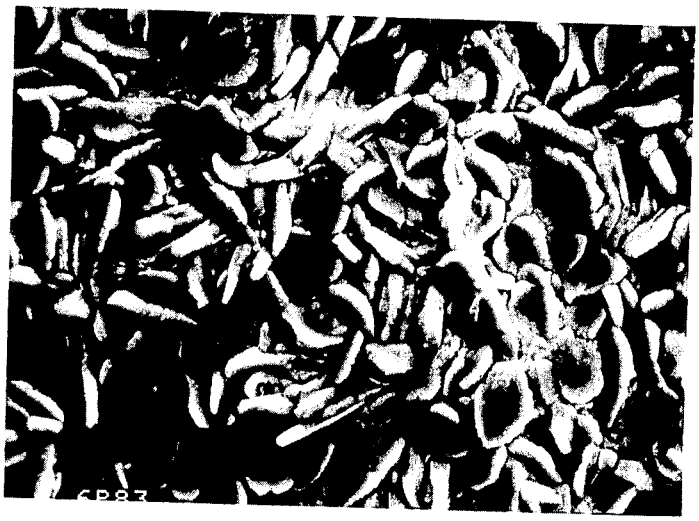

The steel panels that were phosphate coated by this procedure had a uniform, gray appearance and a coating weight of about 1.71 $g/m^2$ (159 $mg/ft^2$). Chemical analysis showed that the nickel content of the phosphate coatings was equal to 5.6% by weight of the total nickel and zinc content of the coating on both the Q and F4 steels. This is equivalent to 6.2 mole percent Ni. A scanning electron microscope photograph of the phosphate coating on the Q steel, taken at 1500× magnification, is shown in FIG. 6. This structure remains similar to the morphology of spray applied commercial zinc phosphate coatings.

The phosphate coated Q and $F_4$ steel panels were spray painted with an epoxy ester-melamine resin based primer. As in Example 1, the paint film thickness, after baking, was approximately 23 micrometers. Salt spray testing was again carried out exactly as detailed in Example 1, with 3 mm undercutting of the paint from the scribe line again considered as failure.

Salt spray testing of the test panels designated Q was discontinued after 480 hours with essentially zero undercutting from the scribe line (see FIG. 4*c*). The test panels designated F4, on the other hand, failed within 96 hours of salt spray testing (see FIG. 4*d*).

EXAMPLE 3

A phosphating bath solution was prepared having the following composition:

3.33 g/l $Zn(H_2PO_4)_2$
6.80 g/l $Ni(H_2PO_4)_2$
2.71 g/l $H_3PO_4$
0.11 g/l $NaNO_2$

As formulated, this bath had a total acid concentration of 14.1 points. The bath acidity was then adjusted by the addition of NaOH to a free acid concentration of 0.9 points, resulting in a total acid to free acid ratio of 16. In a bath of this composition, the dissolved nickel constitutes 67.7 mole percent of the dissolved divalent cations.

Panels of the two steels designated Q and F4, described in Example 1, were spray cleaned and rinsed as detailed in Example 1. After the rinsing step, they were spray phosphated for two minutes with the above phosphate bath heated to 60° C. The panels were then spray rinsed with 20° C. deionized water and dried in an oven at 82° C. for five minutes. As in Example 1, none of the phosphated panels were post-treated with an inhibitor rinse.

Figure 7:
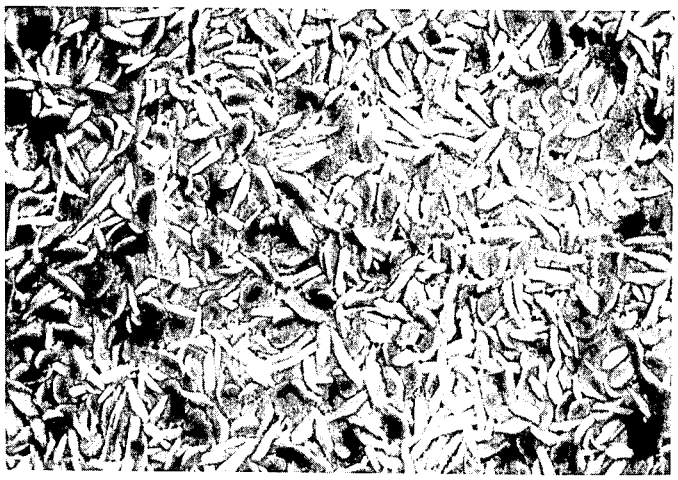

The steel panels that were phosphate coated by this procedure had a uniform, gray appearance and a coating weight of about 1.35 g/m$^2$ (125 mg/ft$^2$). Chemical analysis showed that the nickel content of the phosphate coatings was equal to 7.3% by weight of the total nickel and zinc content of the coating on both the Q and F4 steels. This is equivalent to 8.1 mole percent Ni. A scanning electron microscope photograph of the phosphate coating on the Q steel, taken at 1500× magnification, is shown in FIG. 7. This structure again remains similar to the morphology of spray applied commercial zinc phosphate coatings.

The phosphate coated Q and F4 steel panels were spray painted with an epoxy ester-melamine resin based primer. As in Example 1, the paint film thickness, after baking, was approximately 23 micrometers. Salt spray testing was again carried out exactly as detailed in Example 1, with 3 mm undercutting of the paint from the scribe line again considered as failure.

Salt spray testing of the test panels designated Q was discontinued after 480 hours with essentially zero undercutting from the scribe line (see FIG. 4*e*). The test panels designated F4, on the other hand, failed within 72 hours of salt spray testing (see FIG. 4*f*).

EXAMPLE 4

A phosphating bath solution was prepared having the following composition:

3.01 g/l $Zn(H_2PO_4)_2$
10 07 g/l $Ni(H_2PO_4)_2$
0.89 g/l $H_3PO_4$
0.14 g/l $NaNO_2$

As formulated, this bath had a total acid concentration of 14.2 points. The bath acidity was then adjusted by the addition of NaOH to a free acid concentration of 0.9 points, resulting in a total acid to free acid ratio of 16. In a bath of this composition, the dissolved nickel constitutes 77.4 mole percent of the dissolved divalent cations.

Panels of the two steels designated Q and F4, described in Example 1, were spray cleaned and rinsed as detailed in Example 1. After the rinsing step, they were spray phosphated for two minutes with the above phosphate bath heated to 60° C. The panels were then spray rinsed with 20° C. deionized water and dried in an oven at 82° C. for five minutes. As in Example 1, none of the phosphated panels were post-treated with an inhibitor rinse.

The steel panels that were phosphate coated by this procedure had a uniform, gray appearance and a coating weight of about 1.14 g/m$^2$ (106 mg/ft$^2$). Chemical analysis showed that the nickel content of the phosphate coatings was equal to 11.0% by weight of the total nickel and zinc content of the coating on both the Q and F4 steels. This is equivalent to 12.1 mole percent Ni.

The phosphate coated Q and F4 steel panels were spray painted with an epoxy ester-melamine resin based primer. As in Example 1, the paint film thickness, after baking, was approximately 23 micrometers. Salt spray testing was again carried out exactly as detailed in Example 1, with 3 mm undercutting of the paint from the scribe line again considered as failure.

Salt spray testing of the test panels designated Q was discontinued after 480 hours with essentially zero undercutting from the scribe line (see FIG. 4*g*). The test panels designated F4, on the other hand, failed within 72 hours of salt spray testing (see FIG. 4*h*).

EXAMPLE 5

A phosphating bath solution was prepared having the following composition:

2.14 g/l $Zn(H_2PO_4)_2$
9.21 g/l $Ni(H_2PO_4)_2$
1.42 g/l $H_3PO_4$
0.11 g/l $NaNO_2$

As formulated, this bath had a total acid concentration of 14.2 points. The bath acidity was then adjusted by the addition of NaOH to a free acid concentration of 0.8 points, resulting in a total acid to free acid ratio of 18. In a bath of this composition, the dissolved nickel constitutes 81.5 mole percent of the dissolved divalent cations.

Panels of the two steels designated Q and F4, described in Example 1, were spray cleaned and rinsed as detailed in Example 1. After the rinsing step, they were spray phosphated for two minutes with the above phosphate bath heated to 60° C. The panels were then spray rinsed with 20° C. deionized water and dried in an oven at 82° C. for five minutes. As in Example 1, none of the phosphated panels were post-treated with an inhibitor rinse.

The steel panels that were phosphate coated by this procedure had a uniform, gray appearance and a coating weight of about 1.17 g/m$^2$ (109 mg/ft$^2$). Chemical analysis showed that the nickel content of the phosphate coatings was equal to 11.8% by weight of the total nickel and zinc content of the coating on both the Q and F4 steels. This is equivalent to 13.0 mole percent Ni.

The phosphate coated Q and F4 steel panels were spray painted with an epoxy ester-melamine resin based primer. As in Example 1, the paint film thickness, after baking, was approximately 23 micrometers. Salt spray testing was again carried out exactly as detailed in Example 1, with 3 mm undercutting of the paint from the scribe line again considered as failure.

Figure 9G:
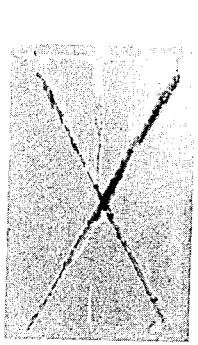
FIG. 9 is also a composite of photographs (**9*a*–9*h***) showing taupe spray painted steel panels, each scratched and subjected to a salt spray corrosion test, and having been phosphated in phosphate baths that were varied incrementally in nickel content (81–85 mole percent).
Figure 9E:
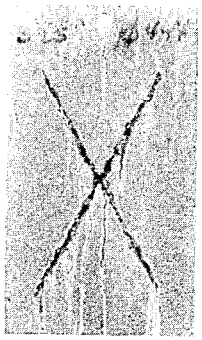
Figure 9C:
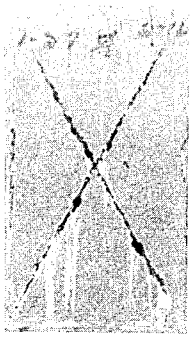
Figure 9A:
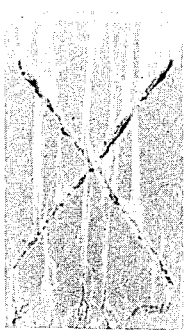
Figure 9H:
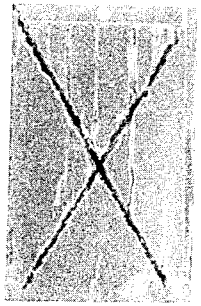
Figure 9F:
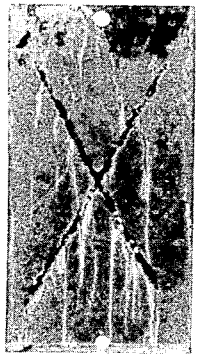
Figure 9D:
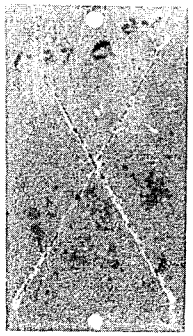
Figure 9B:
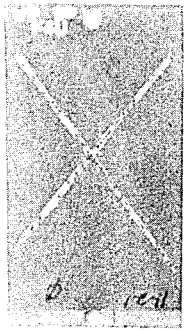

Salt spray testing of the test panels designated Q was discontinued after 480 hours with essentially zero undercutting from the scribe line (see FIG. 9*a*). The test panels designated F4, on the other hand, failed within 120 hours of salt spray testing (see FIG. 9*b*).

EXAMPLE 6

A phosphating bath solution was prepared having the following composition:

2.06 g/l $Zn(H_2PO_4)_2$
9.56 g/l $Ni(H_2PO_4)_2$
1.18 g/l $H_3PO_4$
0.12 g/l $NaNO_2$

As formulated, this bath had a total acid concentration of 14.3 points. The bath acidity was then adjusted by the addition of NaOH to a free acid concentration of 0.7 points, resulting in a total acid to free acid ratio of 20. In a bath of this composition, the dissolved nickel constitutes 82.6 mole percent of the dissolved divalent cations.

Panels of the two steels designated Q and F4, described in Example 1, were spray cleaned and rinsed as detailed in Example 1. After the rinsing step, they were spray phosphated for two minutes with the above phosphate bath heated to 60° C. The panels were then spray rinsed with 20° C. deionized water and dried in an oven at 82° C. for five minutes. As in Example 1, none of the phosphated panels were post-treated with an inhibitor rinse.

Figure 8:
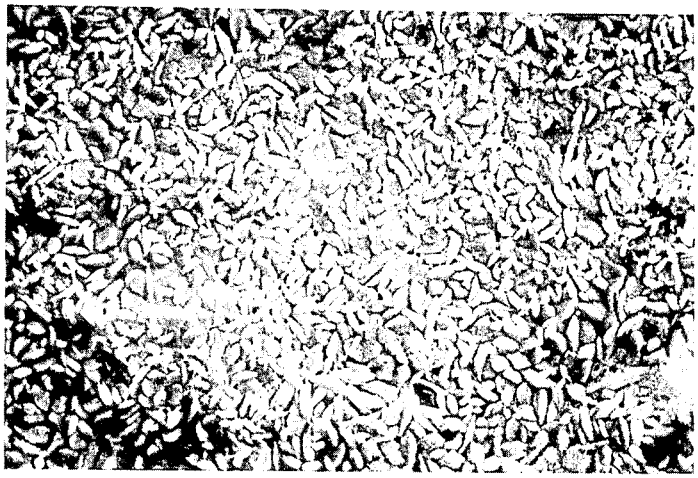

The steel panels that were phosphate coated by this procedure had a uniform, gray appearance and a coating weight of about 1.09 g/m$^2$ (101 mg/ft$^2$). Chemical analysis showed that the nickel content of the phosphate coatings was equal to 12.3% by weight of the total nickel and zinc content of the coating on both the Q and F4 steels. This is equivalent to 13.6 mole percent Ni. A scanning electron microscope photograph of the phosphate coating, taken at 1500× magnification, is shown in FIG. 8. The morphology is similar to that of commercial zinc phosphate, except for a finer-sized crystal structure.

The phosphate coated Q and F4 steel panels were spray painted with an epoxy ester-melamine resin based primer. As in Example 1, the paint film thickness, after baking, was approximately 23 micrometers. Salt spray testing was again carried out exactly as detailed in Example 1, with 3 mm undercutting of the paint from the scribe line again considered as failure.

Salt spray testing of the test panels designated Q was discontinued after 480 hours with essentially zero undercutting from the scribe line (see FIG. 9*c*). The test panels designated F4, on the other hand, failed within 144 hours of salt spray testing (see FIG. 9*d*).

EXAMPLE 7

A phosphating bath solution was prepared having the following composition:

2.18 g/l $Zn(H_2PO_4)_2$
10.07 g/l $Ni(H_2PO_4)_2$
2.08 g/l $H_3PO_4$
0.12 g/l $NaNO_2$

As formulated, this bath had a total acid concentration of 15.6 points. The bath acidity was then adjusted by the addition of NaOH to a free acid concentration of 0.6 points, resulting in a total acid to free acid ratio of 26. In a bath of this composition, the dissolved nickel constitutes 82.6 mole percent of the dissolved divalent cations.

Panels of the two steels designated Q and F4, described in Example 1, were spray cleaned and rinsed as detailed in Example 1. After the rinsing step, they were spray phosphated for two minutes with the above phosphate bath heated to 60° C. The panels were then spray rinsed with 20° C. deionized water and dried in an oven at 82° C. for five minutes. As in Example 1, none of the phosphated panels wee post-treated with an inhibitor rinse.

The steel panels that were phosphate coated by this procedure had a uniform, gray appearance and a coating weight of about 1.45 g/m$^2$ (135 mg/ft$^2$). Chemical analysis showed that the nickel content of the phosphate coatings was equal to 13.1% by weight of the total nickel and zinc content of the coating on both the Q and F4 steels. This is equivalent to 14.4 mole percent Ni.

The phosphate coated Q and F4 steel panels were spray painted with an epoxy ester-melamine resin based primer. As in Example 1, the paint film thickness, after baking, was approximately 23 micrometers. Salt spray testing was again carried out exactly as detailed in Example 1, with 3 mm undercutting of the paint from the scribe line again considered as failure.

Salt spray testing of the test panels designated Q was discontinued after 480 hours with essentially zero undercutting from the scribe line (see FIG. 9*e*). The test panels designated F4, on the other hand, failed within 456 hours of salt spray testing (see FIG. 9*f*).

The improvement in salt spray performance noted for Example 7, compared with Example 6, is an illustration of the importance of the nickel content in the phosphate coating. Note that the dissolved nickel content of the baths described in Examples 6 and 7 are both 82.6 mole percent. However, the higher total-acid to free-acid ratio in Example 7 versus Example 6 resulted in a somewhat higher nickel content in the phosphating coating which in turn resulted in improved corrosion performance.

EXAMPLE 8

A phosphating bath solution was prepared having the following composition:

1.63 g/l $Zn(H_2PO_4)_2$
9.00 g/l $Ni(H_2PO_4)_2$
2.95 g/l $H_3PO_4$
0.13 g/l $NaNO_2$

As formulated, this bath had a total acid concentration of 14.1 points. The bath acidity was then adjusted by the addition of NaOH to a free acid concentration of 0.8 points, resulting in a total acid to free acid ratio of 18. In a bath of this composition, the dissolved nickel constitutes 85.0 mole percent of the dissolved divalent cations.

Panels of the two steels designated Q and F4, described in Example 1, were spray cleaned and rinsed as detailed in Example 1. After the rinsing step, they were spray phosphated for two minutes with the above phosphate bath heated to 60° C. The panels were then spray rinsed with 20° C. deionized water and dried in an oven at 82° C. for five minutes. As in Example 1, none of the phosphated panels were post-treated with an inhibitor rinse.

Figure 10:
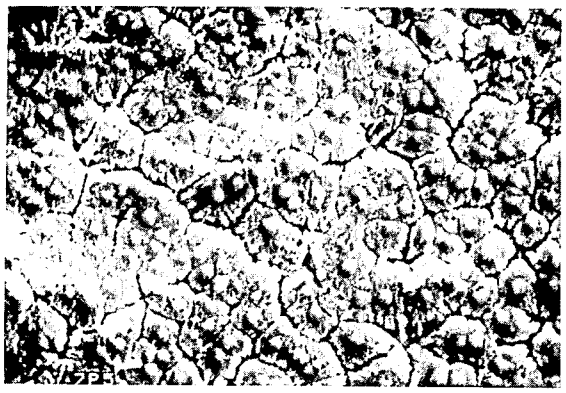
FIGS. 10–13 are scanning electron microscope photographs of the crystalline structure of coatings (at 1500×magnification) corresponding to panel photographs **9*g*, 14*a*, 14*c* and 14*e***.

The steel panels that were phosphate coated by this procedure had a uniform, bluish-gray appearance and a coating weight of about 0.90 g/m$^2$ (84 mg/ft$^2$). Chemical analysis showed that the nickel content of the phosphate coatings was equal to 14.6% by weight of the total nickel and zinc content of the coating on both the Q and F4 steels. This is equivalent to 16.0 mole percent Ni. A scanning electron microscope photograph of the phosphate coating, taken at 1500× magnification, is shown in FIG. 10. This represents an abrupt change in morphology from that shown for the previous examples and suggests an overall change in structure.

The phosphate coated Q and F4 steel panels were spray painted with an epoxy ester-melamine resin based primer. As in Example 1, the paint film thickness, after baking, was approximately 23 micrometers. Salt spray testing was again carried out exactly as detailed in Example 1, with 3 mm undercutting of the paint from the scribe line again considered as failure.

Salt spray testing of the test panels designated Q was discontinued after 480 hours with essentially zero undercutting from the scribe line (see FIG. 9*g*). Salt spray testing of the test panels designated F4 was also discontinued after 480 hours with essentially zero undercutting from the scribe line (see FIG. 9*h*).

EXAMPLE 9

A phosphating bath solution was prepared having the following composition:

1.07 g/l $Zn(H_2PO_4)_2$
9.90 g/l $Ni(H_2PO_4)_2$
0.96 g/l $H_3PO_4$
0.12 g/l $NaNO_2$

As formulated, this bath had a total acid concentration of 13.5 points. The bath acidity was then adjusted by the addition of NaOH to a free acid concentration of 0.9 points, resulting in a total acid to free acid ratio of 15. In a bath of this composition, the dissolved nickel constitutes 90.5 mole percent of the dissolved divalent cations.

Panels of the two steels designated Q and F4, described in Example 1, were spray cleaned and rinsed as detailed in Example 1. After the rinsing step, they were spray phosphated for two minutes with the above phosphate bath heated to 60° C. The panels were then spray rinsed with 20° C. deionized water and dried in an oven at 82° C. for five minutes. As in Example 1, none of the phosphated panels were post-treated with an inhibitor rinse.

Figure 11:
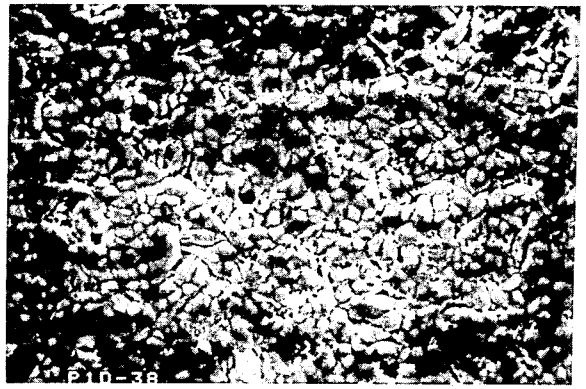

The steel panels that were phosphate coated by this procedure had a uniform, bluish-gray appearance and a coating weight of about 0.86 g/m$^2$ (80 mg/ft$^2$). Chemical analysis showed that the nickel content of the phosphate coatings was equal to 15.1% by weight of the total nickel and zinc content of the coating on both the Q and F4 steels. This is equivalent to 17.0 mole percent Ni. A scanning electron microscope photograph of the phosphate coating, taken at 1500× magnification, is shown in FIG. 11. This structure confirms the abrupt change in morphology shown in FIG. 10, which suggests an overall change in structure.

The phosphate coated Q and F4 steel panels were spray painted with an epoxy ester-melamine resin based primer. As in Example 1, the paint film thickness, after baking, was approximately 23 micrometers. Salt spray testing was again carried out exactly as detailed in Example 1, with 3 mm undercutting of the paint from the scribe line again considered as failure.

Figures 14A, 14B, 14C, 14D, 14E, 14F:
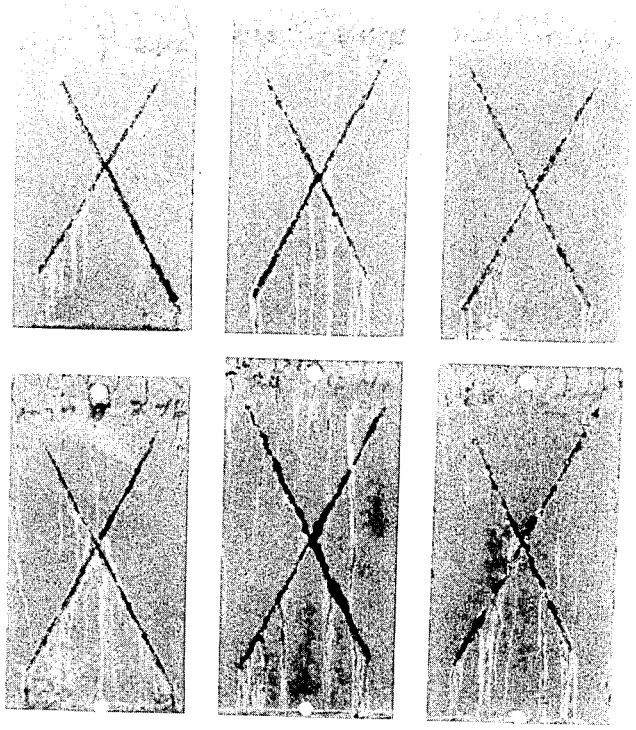
FIG. 14 is similar to FIGS. 4 and 9, showing corrosion tested panels corresponding to phosphating baths with nickel contents of 90.5–92.3.

As in the previous example, salt spray testing of both sets of test panels (Q and F4) was discontinued after 480 hours with essentially zero undercutting from the scribe line (see FIGS. 14*a* and 14*b*).

EXAMPLE 10

A phosphating bath solution was prepared having the following composition:

1.71 g/l $Zn(H_2PO_4)_2$
17.69 g/l $Ni(H_2PO_4)_2$
2.75 g/l $H_3PO_4$
0.11 g/l $NaNO_2$

As formulated, this bath had a total acid concentration of 24.0 points. The bath acidity was then adjusted by the addition of NaOH to a free acid concentration of 0.8 points, resulting in a total acid to free acid ratio of 30. In a bath of this composition, the dissolved nickel constitutes 91.4 mole percent of the dissolved divalent cations.

Panels of the two steels designated Q and F4, described in Example 1, were spray cleaned and rinsed as detailed in Example 1. After the rinsing step, they were spray phosphated for two minutes with the above phosphate bath heated to 60° C. The panels were then spray rinsed with 20° C. deionized water and dried in an oven at 82° C. for five minutes. As in Example 1, none of the phosphated panels were post-treated with an inhibitor rinse.

Figure 12:
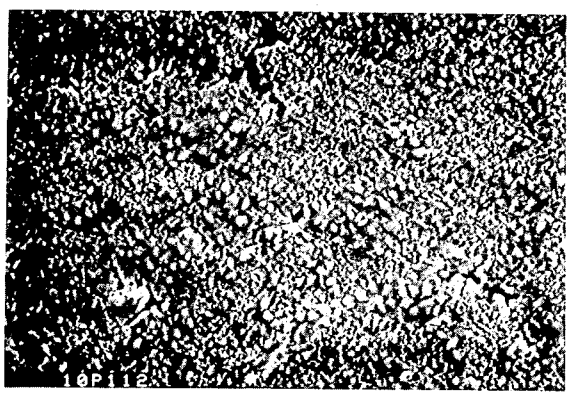

The steel panels that were phosphate coated by this procedure had a uniform, bluish-gray appearance and a coating weight of about 0.62 g/m$^2$ (58 mg/ft$^2$). Chemical analysis showed that the nickel content of the phosphate coatings was equal to 21.0% by weight of the total nickel and zinc content of the coating on both the Q and F4 steels. This is equivalent to 22.8 mole percent Ni. A scanning electron microscope photograph of the phosphate coating, taken at 1500× magnification, is shown in FIG. 12. This structure is similar to that shown in FIGS. 10 and 11.

The phosphate coated Q and F4 steel panels were spray painted with an epoxy ester-melamine resin based primer. As in Example 1, the paint film thickness, after baking, was approximately 23 micrometers. Salt spray testing was again carried out exactly as detailed in Example 1, with 3 mm undercutting of the paint from the scribe line again considered as failure.

As in Examples 8 and 9, salt spray testing of both sets of test panels (Q and F4) was discontinued after 480 hours with essentially zero undercutting from the scribe line (see FIGS. 14*c* and 14*d*).

EXAMPLE 11

A phosphating bath solution was prepared having the following composition:

1.55 g/l $Zn(H_2PO_4)_2$
18.04 g/l $Ni(H_2PO_4)_2$
2.89 g/l $H_3PO_4$
0.12 g/l $NaNO_2$

As formulated, this bath had a total acid concentration of 24.4 points. The bath acidity was then adjusted by the addition of NaOH to a free acid concentration of 0.5 points, resulting in a total acid to free acid ratio of 49. In a bath of this composition, the dissolved nickel constitutes 92.3 mole percent of the dissolved divalent cations.

Panels of the two steels designated Q and F4, described in Example 1, were spray cleaned and rinsed as detailed in Example 1. After the rinsing step, they were spray phosphated for two minutes with the above phosphate bath heated to 60° C. The panels were then spray rinsed with 20° C. deionized water and dried in an oven at 82° C. for five minutes. As in Example 1, none of the phosphated panels were post-treated with an inhibitor rinse.

Figure 13:
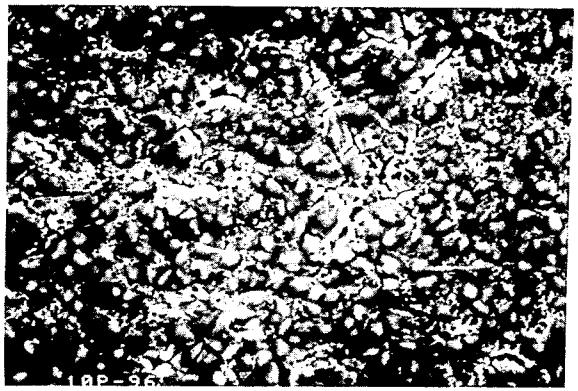

The steel panels that were phosphate coated by this procedure had a uniform, bluish-gray appearance and a coating weight of about 0.52 g/m$^2$ (48 mg/ft$^2$). Chemical analysis showed that the nickel content of the phosphate coatings was equal to 24.8% by weight of the total nickel and zinc content of the coating on both the Q and F4 steels. This is equivalent to 26.9 mole percent Ni. A scanning electron microscope photograph of the phosphate coating, taken at 1500× magnification, is shown in FIG. 13. This structure is similar to that shown in FIGS. 10, 11 and 12.

The phosphate coated Q and F4 steel panels were spray painted with an epoxy ester-melamine resin based primer. As in Example 1, the paint film thickness, after baking, was approximately 23 micrometers. Salt spray testing was again carried out exactly as detailed in Example 1, with 3 mm undercutting of the paint from the scribe line again considered as failure.

As in Examples 8, 9 and 10, salt spray testing of both sets of test panels (Q and F4) was discontinued after 480 hours with essentially zero undercutting from the scribe line (see FIGS. 14*e* and 14*f*).

EXAMPLE 12

A phosphating bath solution was prepared having the following composition:

0.63 g/l $Zn(H_2PO_4)_2$
12.22 g/l $Ni(H_2PO_4)_2$
1.10 g/l $H_3PO_4$
0.11 g/l $NaNO_2$

As formulated, this bath had a total acid concentration of 14.8 points. The bath acidity was then adjusted by the addition of NaOH to a free acid concentration of 0.8 points, resulting in a total acid to free acid of 18. In a bath of this composition, the dissolved nickel constitutes 95.2 mole percent of the dissolved divalent cations.

Panels of the two steels designated Q and F4, described in Example 1, were spray cleaned and rinsed as detailed in Example 1. After the rinsing step, they were spray phosphated for two minutes with the above phosphate bath heated to 60° C. The panels were then spray rinsed with 20° C. deionized water and dried in an oven at 82° C. for five minutes. As in Example 1, none of the phosphated panels were post-treated with an inhibitor rinse.

The steel panels that were phosphate coated by this procedure had a very nonuniform, streaked and spotted appearance and varied in color from light gray to black. Coating weight varied from about 0.28 to 0.70 g/m$^2$ (26 to 65 mg/ft$^2$). Chemical analysis showed that the nickel content of the phosphate coatings was equal to 41.3% by weight of the total nickel and zinc content of the coating on the Q steel panels. This is equivalent to 43.9 mole percent Ni. The coating also contained a high iron content, which is undesirable. A scanning electron microscope photograph of the phosphate coating, taken at 1500× magnification, is shown in FIG. 15.

Although this structure resembles the structures observed for coatings with nickel contents in the range of 13–25% by weight, the nonuniform visual appearance, nonuniformity of coating weight, and high porosity were judged unsatisfactory for commercial application, therefore no painted test panels were prepared for corrosion testing.

Examples 1 through 12 show, collectively, that there is a very narrow, sharply demarcated range of nickel contents in nickel/zinc phosphate conversion coatings which will consistently confer outstanding salt spray corrosion resistance upon subsequently painted commercial steel sheet, such as auto body steel sheet, which may be contaminated with carbon. This range of nickel contents, which Examples 1 through 12, collectively, have shown to be characterized by a phosphate coating having a microstructure distinctly different from the microstructure of ordinary commercial zinc phosphate coatings, is from about 16 (Example 8) mole percent to about 27 (Example 11) to about 44 (Example 12) to about 95.2 mole percent nickel, corresponding to about 85 to about 92.3 mole percent dissolved nickel in the phosphating bath. Depending upon the ratio of total-acid to free-acid, slight variations on these limits are possible. For the sake of simplicity, Examples 1 through 12 have dealt with phosphate coatings applied over two steels, one with low surface carbon contamination and one with moderate surface carbon contamination; and with one paint, an epoxy ester-melamine resin based primer applied by spraying. It must be understood that many of the phosphates described in Examples 1 through 12, as well as other compositions not included in those examples, were applied to a variety of other substrates, such as steels having various other levels of surface carbon contamination, hot-dipped galvanized steel, and aluminum. In addition, phosphated test panels of these substrates were corrosion tested in salt spray after the application of a commercial cathodic electrocoat primer as well as the spray primer referred to in Examples 1 through 12. Again, consistently outstanding salt spray performance was observed only when the nickel content in the phosphating bath was in the range of about 84–94 mole percent of the dissolved divalent cations.

The following example will serve to illustrate the benefits obtained on substrates other than steel, particularly on the zinc surface of hot-dipped galvanized steel, which result from the formation of a phosphate conversion coating having a nickel content within the narrowly restricted range established for steel substrates in the previous examples.

EXAMPLE 13

A phosphating bath solution was prepared having the following composition:

1.42 g/l $Zn(H_2PO_4)_2$
13.02 g/l $Ni(H_2PO_4)_2$
2.05 g/l $H_3PO_4$
0.47 g/l NaF 0.08 g/l $NaNO_2$

As formulated, this bath had a total acid concentration of 18.1 points. The bath acidity was then adjusted by the addition of NaOH to a free acid concentration of 0.7 points, resulting in a total acid to free acid ratio of 26. In a bath of this composition, the dissolved nickel constitutes 90.7 mole percent of the dissolved divalent cations.

Panels of the two steels designated Q and F4, described in Example 1, and of hot-dipped galvanized steel, were spray cleaned and rinsed as detailed in Example 1. After the rinsing step, they were spray phosphated for two minutes with the above phosphate bath heated to 60° C. The panels were then spray rinsed with 20° C. deionized water and dried in an oven at 82° C. for five minutes. As in Example 1, none of the phosphated panels were post-treated with an inhibitor rinse.

The steel panels that were phosphate coated by this procedure had a uniform, bluish-gray appearance and a coating weight of about 0.92 g/m$^2$ (85 mg/ft$^2$). Grayish-black phosphate coatings with a weight of about 1.67 g/m$^2$ (155 mg/ft$^2$) were produced on the hot-dipped galvanized steel panels. Chemical analysis showed that the nickel content of the phosphate coatings was equal to 16.2% by weight of the total nickel and zinc content of the coating. This is equivalent to 17.7 mole percent Ni.

The phosphate coated Q and F4 steel panels and the phosphate coated galvanized steel panels were spray painted with an epoxy ester-melamine resin based primer. As in Example 1, the paint film thickness, after baking, was approximately 23 micrometers. Salt spray testing was again carried out exactly as detailed in Example 1, with 3 mm undercutting of the paint from the scribe line again considered as failure.

As in Examples 8, 9, 10 and 11, salt spray testing of both sets of test panels (Q and F4) was discontinued after 480 hours with essentially zero undercutting from the scribe line. While the galvanized steel panels were not free from undercutting after 360 hours of testing, there was a very considerable improvement over the performance considered as typical of commerical zinc phosphates. FIG. 16 illustrates the improvement in 360 hour and 480 hour salt spray performance for galvanized steel with high mole percent nickel in the phosphate coating (FIGS. 16*a* and 16*b*) via-a-vis commercial zinc phosphate containing a low nickel level (FIGS. 16*c* and 16*d*). The high nickel phosphate shows a marked advantage in degree of salt spray undercutting of the paint as well as in the progression of undercutting with time.

Table I is a tabulation setting forth for each panel used in FIGS. 4, 9 and 14: (a) the bath composition used, including the amount of zinc and nickel by mole percent of the combined Ni and Zn, weight percent of nickel or zinc as percent of the combined nickel and zinc, weight in grams of each solute element per liter, and weight percent of each solute element of the total bath solution; (b) the coating composition, including mole percent nickel and zinc of the total Ni and Zn, weight percent of nickel and zinc of the total nickel and zinc, and weight percent in the coating of principal ingredients.

Table II is a tabulation setting forth the physical characteristics of the coatings for the panels listed in Table I.

In a further study done to confirm the observed structural changes in the phosphate coatings illustrated in FIGS. 5, 6, 7, 8, 10, 11, 12 and 13, phosphate coatings representative of various levels of nickel in the phosphating bath were examined by infrared analysis, making use of an attenuated total reflectance technique. The results, summarized as a series of absorbance spectra, are shown in FIGS. 17*a*–17*f*. FIG. 17*a* is the spectrum typical of commercial zinc phosphate, corresponding to Example 1. There are only gradual changes in this spectrum with increasing nickel content of the phosphating bath over the range of 33.3 mole percent, corresponding to Example 1, through 82.6 mole percent, corresponding to Example 6. However, beginning with the attainment of a level of 85.0 mole percent, corresponding to Example 8, there is a gradual change in the spectrum, as shown in FIG. 17*d*, confirming the change in structure illustrated in the scanning electron microscope photograph shown in FIG. 10.

TABLE I

| | | Phosphating Bath | | | | | | | | | | | |
|---|---|---|---|---|---|---|---|---|---|---|---|---|---|
| | | Molar % of Ni—Zn | | | Wt. % of Ni—Zn | | | Wt. in Grams Per Liter | | | Wt. % of Solution | | |
| Example | Substrate | % Ni | % Zn | Ni/Zn Ratio | % Ni | % Zn | Ni/Zn Ratio | ++ Ni | ++ Zn | Total | Ni | Zn | $PO_4$ |
| 1a | Q | 33.3 | 66.7 | 0.50 | 30.9 | 69.1 | 0.45 | 0.25 | 0.56 | 0.81 | .024 | .054 | 0.79 |
| 1b | F | | | | | | | | | | | | |
| 2a | Q | 57.9 | 42.1 | 1.38 | 55.2 | 44.8 | 1.23 | 1.38 | 1.12 | 2.50 | .13 | .10 | 1.02 |
| 2b | F | | | | | | | | | | | | |
| 3a | Q | 67.7 | 32.3 | 2.10 | 65.3 | 34.7 | 1.88 | 1.58 | 0.84 | 2.42 | .15 | .08 | .94 |
| 3b | F | | | | | | | | | | | | |
| 4a | Q | 77.4 | 22.6 | 3.42 | 75.5 | 24.5 | 3.08 | 2.34 | 0.76 | 3.10 | .21 | .07 | .96 |
| 4b | F | | | | | | | | | | | | |
| 5a | Q | 81.5 | 18.5 | 4.40 | 79.8 | 20.2 | 3.95 | 2.14 | 0.54 | 2.68 | .20 | .05 | .91 |
| 5b | F | | | | | | | | | | | | |
| 6a | Q | 82.6 | 17.4 | 4.75 | 81.0 | 19.0 | 4.26 | 2.22 | 0.52 | 2.74 | .20 | .05 | .90 |
| 6b | F | | | | | | | | | | | | |
| 7a | Q | 82.6 | 17.4 | 4.75 | 81.0 | 19.0 | 4.26 | 2.34 | 0.55 | 2.89 | .21 | .05 | 1.03 |
| 7b | F | | | | | | | | | | | | |
| 8a | Q | 85.0 | 15.0 | 5.67 | 83.6 | 16.4 | 5.10 | 2.09 | 0.41 | 2.50 | .19 | .04 | 1.00 |
| 8b | F | | | | | | | | | | | | |
| 9a | Q | 90.5 | 9.5 | 9.53 | 89.5 | 10.5 | 8.52 | 2.30 | 0.27 | 2.57 | .21 | .02 | .85 |
| 9b | F | | | | | | | | | | | | |
| 10a | Q | 91.4 | 8.6 | 10.6 | 90.5 | 9.5 | 9.53 | 4.10 | 0.43 | 4.53 | .36 | .04 | 1.50 |
| 10b | F | | | | | | | | | | | | |
| 11a | Q | 92.3 | 7.7 | 12.0 | 91.5 | 8.5 | 10.8 | 4.19 | 0.39 | 4.58 | .36 | .03 | 1.52 |
| 11b | F | | | | | | | | | | | | |
| 12a | Q | 95.2 | 4.8 | 19.8 | 94.7 | 5.3 | 17.9 | 0.84 | 0.16 | 3.00 | .26 | .01 | 98 |
| 12b | F | | | | | | | | | | | | |
| 13a | Q—Zn | 90.7 | 9.3 | 9.75 | 89.7 | 10.3 | 8.71 | 3.02 | 0.36 | 3.38 | .27 | .03 | 1.17 |
| 13b | F—Zn | | | | | | | | | | | | |

| | | Phosphate Coating | | | | | | | | | |
|---|---|---|---|---|---|---|---|---|---|---|---|
| | | Molar % of Ni—Zn | | | Wt. % of Ni—Zn | | | Wt. % of Coating (less water) | | | |
| Example | Substrate | % Ni | % Zn | Ni/Zn Ratio | % Ni | % Zn | Ni/Zn Ratio | % Ni | % Zn | % $PO_4$ | % Fe |
| 1a | Q | 8.5 | 96.5 | .036 | 3.2 | 96.8 | .033 | 1.3 | 39.0 | 52.1 | 7.6 |
| 1b | F | | | | | | | | | | |
| 2a | Q | 6.2 | 93.8 | .066 | 5.6 | 94.4 | .059 | 2.5 | 43.1 | 50.7 | 3.7 |
| 2b | F | | | | | | | | | | |
| 3a | Q | 8.1 | 91.9 | .088 | 7.3 | 92.7 | .079 | 3.3 | 42.3 | 50.7 | 3.7 |
| 3b | F | | | | | | | | | | |
| 4a | Q | 12.1 | 87.9 | .14 | 11.0 | 89.0 | .12 | 4.9 | 39.9 | 51.1 | 4.1 |
| 4b | F | | | | | | | | | | |
| 5a | Q | 13.0 | 87.0 | .15 | 11.8 | 88.2 | .13 | 5.4 | 40.1 | 50.9 | 3.6 |
| 5b | F | | | | | | | | | | |
| 6a | Q | 13.6 | 86.4 | .16 | 12.3 | 87.7 | .14 | 5.5 | 39.1 | 51.2 | 4.2 |
| 6b | F | | | | | | | | | | |
| 7a | Q | 14.4 | 85.6 | .17 | 13.1 | 86.9 | .15 | 5.4 | 35.5 | 52.1 | 7.0 |
| 7b | F | | | | | | | | | | |
| 8a | Q | 16.0 | 84.0 | .19 | 14.6 | 85.4 | .17 | 6.2 | 36.2 | 51.7 | 5.9 |

TABLE I-continued

| | | | | | | | | | | | |
|---|---|---|---|---|---|---|---|---|---|---|---|
| 8b | F | | | | | | | | | | |
| 9a | Q | 17.0 | 83.0 | .20 | 15.5 | 84.5 | .18 | 6.1 | 33.2 | 52.6 | 8.1 |
| 9b | F | | | | | | | | | | |
| 10a | Q | 22.8 | 77.2 | .30 | 21.0 | 79.0 | .27 | 8.2 | 31.1 | 52.6 | 8.1 |
| 10b | F | | | | | | | | | | |
| 11a | Q | 26.9 | 73.1 | .37 | 24.8 | 75.2 | .33 | 8.8 | 26.5 | 53.7 | 11.0 |
| 11b | F | | | | | | | | | | |
| 12a | Q | 43.9 | 56.1 | .78 | 41.3 | 58.7 | .70 | 12.9 | 18.3 | 55.0 | 13.8 |
| 12b | F | | | | | | | | | | |
| 13a | Q—Zn | 17.7 | 82.3 | .22 | 16.2 | 83.8 | .19 | 6.5 | 36.4 | 51.5 | 5.6 |
| 13b | F—Zn | | | | | | | | | | |

TABLE II

PHYSICAL CHARACTERISTICS OF PHOSPHATE COATING

| Panel | Morphology | Solubility in NaOH (amt. undissolved after 30 min.) | Salt-Spray Life Hours to Loss of Paint Adhesion | Amount of Paint Undercutting | Uniformity of Coating | Major Solidification Structure of Coating |
|---|---|---|---|---|---|---|
| 1a | Platelet | 35–40% | 480 | 0 | Ok, Gray | $Zn_3(PO_4)_2.4H_2O$ (Hopeite); |
| 1b | " | " | 96 | >3 mm | " | $Zn_3Fe(PO_4)_2.4H_2O$ |
| 2a | " | " | 480 | 0 | " | $Zn_3(PO_4)_2.4H_2O$ (Hopeite); |
| 2b | " | " | 96 | >3 mm | " | $Zn_3Fe(PO_4)_2.4H_2O$ |
| 3a | " | " | 480 | 0 | " | $Zn_3(PO_4)_2.4H_2O$ (Hopeite); |
| 3b | " | " | 72 | >3 mm | " | $Zn_3Fe(PO_4)_2.4H_2O$ |
| 4a | " | " | 480 | 0 | " | $Zn_3(PO_4)_2.4H_2O$ (Hopeite); |
| 4b | " | " | 72 | >3 mm | " | $Zn_3Fe(PO_4)_2.4H_2O$ |
| 5a | " | " | 480 | 0 | " | $Zn_3(PO_4)_2.4H_2O$ (Hopeite); |
| 5b | " | " | 120 | >3 mm | " | $Zn_3Fe(PO_4)_2.4H_2O$ |
| 6a | " | " | 480 | 0 | " | $Zn_3(PO_4)_2.4H_2O$ (Hopeite); |
| 6b | " | " | 144 | >3 mm | " | $Zn_3Fe(PO_4)_2.4H_2O$ |
| 7a | " | " | 480 | 0 | " | $Zn_3(PO_4)_2.4H_2O$ (Hopeite); |
| 7b | " | " | 456 | >3 mm | " | $Zn_3Fe(PO_4)_2.4H_2O$ |
| 8a | Continuous Nodular | 70% | 480 | 0 | Ok, Bluish Gray | $Zn_2Ni(PO_4)_2.4H_2O$ |
| 8b | Continuous Nodular | " | 480 | 0 | Ok, Bluish Gray | " |
| 9a | Continuous Nodular | " | 480 | 0 | Ok, Bluish Gray | " |
| 9b | Continuous Nodular | " | 480 | 0 | Ok, Bluish Gray | " |
| 10a | Continuous Nodular | " | 480 | 0 | Ok, Bluish Gray | " |
| 10b | Continuous Nodular | " | 480 | 0 | Ok, Bluish Gray | " |
| 11a | Continuous Nodular | " | 480 | 0 | Ok, Bluish Gray | " |
| 11b | Continuous Nodular | " | " | 0 | Ok, Bluish Gray | " |
| 12a | Discontinuous Nodular (not well formed) | 40–60% | Not Tested | — | Nonuniform (blackish) | $Fe_2O_3$ (hydrated), $FePO_4$ and $Zn_3Fe(PO_4)_2.4H_2O$ |
| 12b | Discontinuous Nodular (not well formed) | " | " | — | Nonuniform (blackish) | $Fe_2O_3$ (hydrated), $FePO_4$ and $Zn_3Fe(PO_4)_2.4H_2O$ |
| 13a | Continuous Nodular | >70% | 480 | 1 mm | Ok, Bluish Gray | $Zn_2Ni(PO_4)_2.4H_2O$ |
| 13b | Continuous Nodular | " | " | 1 mm | Ok, Bluish Gray | " |

The change in the spectrum becomes more pronounced with increasing nickel percentage in the phosphating bath, as shown in FIGS. 17*e* and 17*f*, which correspond to Example 9 and Example 11, respectively.

Additional experimental work was carried out to demonstrate the qualities of the films obtained with nickel cations used as the first divalent metal cations when used in bath concentrations above the range herein taught, i.e., nickel cation concentrations in the bath in excess of 95 mole percent. These experimental studies are summarized in the examples given below.

EXAMPLE 14

A phosphating bath solution was prepared having the following composition:

0.52 g/l $Zn(H_2PO_4)_2$
15.95 g/l $Ni(H_2PO_4)_2$
2.66 g/l $H_3PO_4$ 0.69 g/l NaF
0.09 g/l $NaNO_2$

As formulated, this bath had a total acid concentration of 20.5 points. The bath acidity was then adjusted by the addition of NaOH to a free acid concentration of 0.65 points, resulting in a total acid to free acid ratio of 32. In a bath of this composition, the dissolved nickel constitutes 97.0 mole percent of the dissolved divalent cations.

Panels of the two steels designated Q and F4, described in Example 1, were spray cleaned and rinsed as detailed in Example 1. After the rinsing step, they were spray phosphated for two minutes with the above phosphate bath heated to 60° C. The panels were then spray rinsed with 20° C. deionized water and dried in an oven at 82° C. for five minutes. As in Example 1, none of the phosphated panels were post-treated with an inhibitor rinse.

Figure 18:
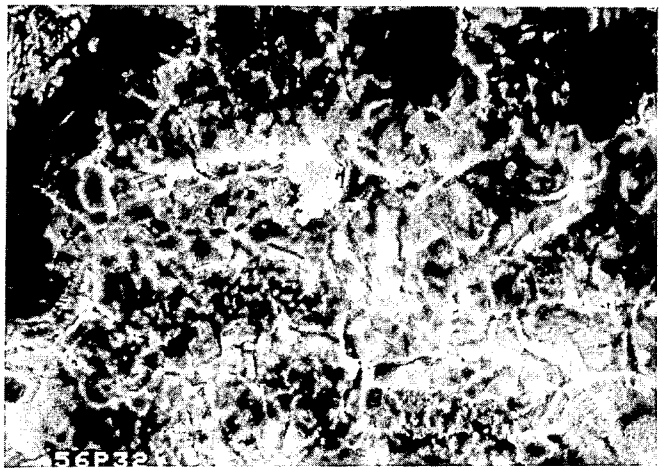
FIG. 18 is a scanning electron microscope photograph of a coating (at 1500×magnification) prepared in a phosphate bath containing 97.0 mole percent nickel.

As in Example 12, the steel panels that were phosphate coated by this procedure had a nonuniform, streaked and spotted appearance, and has a brownish color without the bluish-gray cast. Coating weight varied from 0.56 to 0.74 g/m$^2$ (52 to 69 mg/ft$^2$). Chemical analysis showed that the nickel content of the phosphate coatings was equal to 56.6% by weight of the total nickel and zinc content of the coating on the Q steel panels. This is equivalent to 59.2 mole percent Ni. The coating also contained a high iron content, which is undesirable. A scanning electron microscope photograph of phosphate coating, taken at 1500× magnification, is shown in FIG. 18. In common with FIGS. 10, 11, 12 and 13, this structure is very dissimilar to the structure of conventional zinc phosphate; however, neither does it closely resemble the nickel/zinc phosphate structure shown in FIGS. 10, 11, 12 and 13.

The phosphate coated Q and F4 steel panels were spray painted with an epoxy ester-melamine resin based primer. As in Example 1, the paint film thickness, after baking, was approximately 23 micrometers. Salt spray testing was again carried out exactly as detailed in Example 1, with 3 mm undercutting of the paint from the scribe line again considered as failure.

Figure 19A:
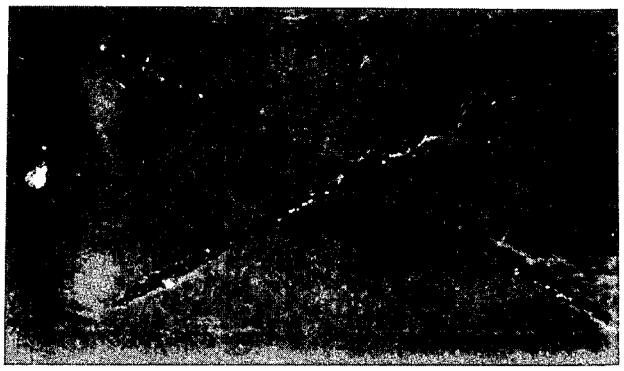
Figure 19B:
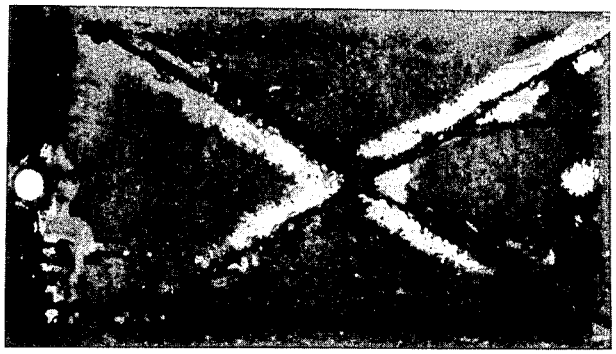
Figure 19C:
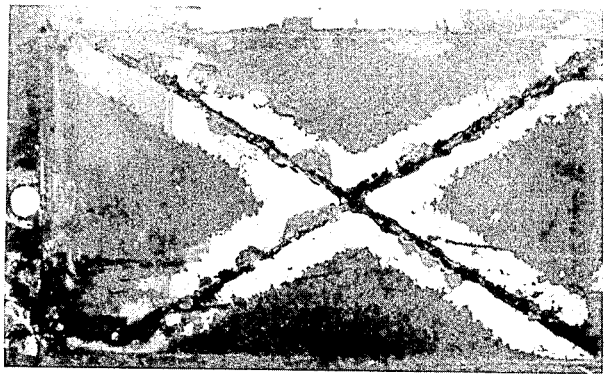

Salt spray testing of the test panel designated Q was discontinued after 480 hours with essentially zero undercutting from the scribe line (see FIG. 19). A test panel designated F4, on the other hand, subjected to 288 hours of salt spray testing failed badly. This result was corroborated by extending the salt spray testing to 480 hours on a second painted test panel prepared from F4 steel which showed even greater undercutting from the scribe line as would be expected from the result obtained in the 288 hour test. Results for the F4 panels are also shown in FIG. 19.

Comparison of the above test results with those reported from Examples 8, 9, 10 and 11 offers clear evidence that the range of nickel concentrations which provides greatly improved corrosion resistance for phosphated and painted panels is severely restricted and is not anticipated by Ries et al.

EXAMPLE 15

It has become a well known practice in recent years, among many of the world's major automobile manufacturers, to prime their vehicles for final painting by applying corrosion resistant epoxy-based primer by an electrophoretic deposition process, commonly known as electrocoating, as an alternative to the use of epoxy ester-melamine resin based primer applied by spraying. Of the various electrocoat primers available, those which are cathodically deposited are widely acknowledged as providing the best corrosion resistance.

In order to demonstrate that phosphate coatings having compositions within the restricted range claimed for our invention will give outstanding results, when used as a base for cathodic electrocoat primer to be applied over steels with very high surface-carbon contamination, a phosphating bath solution was prepared having the following composition:

1.75 g/l $Zn(H_2PO_4)_2$
15.52 g/l $Ni(H_2PO_4)_2$
3.72 g/l $H_3PO_4$
0.67 g/l NaF
0.07 g/l $NaNO_2$

As formulated, this bath had a total acid concentration of 23.1 points. The bath acidity was then adjusted by the addition of NaOH to a free acid concentration of 0.8 points, resulting in a total acid to free acid ratio of 29. In a bath of this composition, the dissolved nickel constitutes 90.1 mole percent of the dissolved divalent cations, which is similar to the composition described in Example 9.

Steel panels of two types were selected for phosphating with the above phosphating composition. The first type, designated as Q steel, was a commercially available steel test panel having very low surface carbon contamination, typically in the range of less than 1 mg/m$^2$ (0.093 mg/ft$^2$) as described in Example 1. However, the second type of panel was cut from commercial auto body sheet, identified as F6. This steel was more severly contaminated than the F4 steel referred to in previous examples. It was known to have surface carbon values in the range of 8.8 to 17.3 mg/m$^2$ (0.82 to 1.61 mg/ft$^2$), and to be subject to early salt spray failure in tests with cathodic electrocoat primers applied over conventional zinc phosphates.

Panels of Q steel and F6 steel were spray cleaned and rinsed as detailed in Example 1. After the rinsing step, they were spray phosphated for two minutes with the above phosphate bath heated to 60° C. The panels were then spray rinsed with 20° C. deionized water and dried in an oven at 82° C. for five minutes. As in Example 1, none of the phosphated panels were post-treated with an inhibitor rinse.

The steel panels that were phosphate coated by this procedure had a uniform, bluish-gray appearance and a coating weight of about 1.08 g/m$^2$ (100 mg/ft$^2$). Chemical analysis showed that the nickel content of the phosphate coatings was equal to 16.8% by weight of the total nickel and zinc content of the coating on both the Q and F6 steels. This is equivalent to 18.4 mole percent Ni. A scanning electron microscope photograph of phosphate coating, taken at 1500× magnification, is shown in FIG. 20. This structure is similar to that shown in FIGS. 10, 11, 12 and 13.

The phosphate coated Q and F6 steel panels were cathodically electrocated with an epoxy based primer. The paint film thickness, after baking, was approximately 22 micrometers. Salt spray testing was again carried out exactly as detailed in Example 1, with 3 mm undercutting of the paint from the scribe line considered as failure.

Salt spray testing of the test panel designated Q was discontinued after 1440 hours with essentially zero undercutting from the scribe line. Salt spray testing of the carbon-contaminated test panel designated F6 was also discontinued after 1440 hours with essentially zero undercutting of the paint from the scribe line. These results are illustrated in FIG. 21.

EXAMPLE 16

In order to furnish further evidence that the range of nickel concentration which provides greatly improved corrosion resistance is severely restricted, a phosphating bath was prepared having the following composition:

0.18 g/l $Zn(H_2PO_4)_2$
17.10 g/l $Ni(H_2PO_4)_2$
1.44 g/l $H_3PO_4$
0.67 g/l NaF
0.09 g/l $NaNO_2$

As formulated, this bath had a total acid concentration of 19.7 points. The bath acidity was then adjusted by the addition of NaOH to a free acid concentration of 0.65 points, resulting in a total acid to free acid ratio of 30. In a bath of this composition, the dissolved nickel constitutes 99.0 mole percent of the dissolved divalent cations.

Panels of the two steels designated Q and F6, described in Example 15, were spray cleaned and rinsed as detailed in Example 1. After the rinsing step, they were spray phosphated for two minutes with the above phosphate bath heated to 60° C. The panels were then spray rinsed with 20° deionized water and dried in an oven at 82° C. for five minutes. As in Example 1, none of the phosphated panels were post-treated with an inhibitor rinse.

The steel panels that were phosphate coated by this procedure has a very nonuniform, streaked and spotted appearance, and varied in color from light gray to bluish-black. Coating weight varied from 0.24 to 0.93 $g/m^2$ (22 to 86 $mg/ft^2$). Chemical analysis showed that the nickel content of the phosphate coatings was equal to 90.2% by weight of the total nickel and zinc content of the coating on the Q steel panels. This is equivalent to 91.1 mole percent Ni. The coating also contained a high iron content, which is undesirable. A scanning electron microscope photograph of phosphate coating, taken at 1500× magnification, is shown in FIG. 22. This structure is different from FIG. 20 and represents a significant departure from the structure shown in FIGS. 10, 11, 12 and 13.

The phosphate coated Q and F6 steel panels were cathodically electrocoated with the same epoxy based primer used on the panels described in Example 15. The paint film thickness, after baking, was approximately 22 micrometers. Salt spray testing was again carried out exactly as detailed in Example 1, with 3 mm undercutting of the paint from the scribe line considered as failure.

In order to allow a direct comparison with the phosphate described in Example 15, salt spray testing on both the Q and the F6 panels was carried out for 1440 hours. Unlike the panels shown in FIG. 21, however, neither of these panels passed the test. Failure was eveident on both the Q panel, with a low level of carbon contamination, and the F6 panel, with a high level of carbon contamination. These results are shown in FIG. 23.

Again, this direct comparison of test results provides clear evidence that nickel concentrations in the range of 99 mole percent do not provide the greatly improved corrosion resistance for phosphated and painted panels which is obtained within the restricted range of 84–94 mole percent claimed for our invention. This direct comparison also shows that Ries et al, in claiming the entire range from 59 to 99.9 mole percent of nickel, could not have been aware of the severe degradation in corrosion performance that results from the use of nickel concentrations of between 95 and 100 mole percent.

Additional experimental work was carried out with magnesium and the transition elements cobalt and manganese, each of which have a hydroxide with lower solubility in an alkaline solution than zinc hydroxide. A number of separate phosphating baths were prepared. The specific bath compositions investigated which contained zinc in combination with cobalt (Examples 17–26), magnesium (Examples 27–37), or manganese (Examples 38–50) are given in Table III, Table IV and Table V, respectively. The total-acid, free-acid, and acid ratio values listed are after adjustment of the bath acidity by the addition of sodium hydroxide. Also shown for each bath is the mole percent of the dissolved divalent cations.

For Examples 17–50, test panels of 4×12" size of the steels designated Q and F6, described in Examples 1 and 15 respectively, were spray cleaned for two minutes with a conventional alkaline cleaner having a strength of 4 to 6 points and a temperature of 60° C., spray rinsed for 30 seconds with 60° C. tap water, and spray phosphated for two minutes with the respective phosphate bath heated to 57° C. The panels were then spray rinsed with 20° C. deionized water for one minute and dried in an oven at 82° C. for five minutes. As in Example 1, none of the phosphated panels were post-treated with an inhibitor rinse.

A portion of the phosphated Q steel panels was used for determination of composition, coating weight, and x-ray structure of the phosphate coating. The mole percent of metal divalent cations, exclusive of iron, in the phosphate coating and coating weight are listed in Tables III to V for each phosphate bath investigated.

For evaluation of corrosion performance, the phosphated F6 steel panels were painted with either a commercial cathodic electrocoat primer or an epoxy ester-melamine resin based spray primer, as indicated with the Tables. The samples, after baking, were then scribed in an "X" pattern to bare metal and then subjected to accelerated salt spray, cathodic delamination, and scab corrosion tests. Descriptions of these tests are as follows.

Salt Spray Test

The test was conducted in accordance with the ASTM B117 procedure. It consists essentially of exposing the scribed test panels to a mist of a 5% sodium chloride solution in an enclosed chamber maintained at 35° C.

Cathodic Delamination Test

This test consists of immersing scribed test panels in an oxygen saturated 5% sodium chloride solution at room temperature and cathodically polarizing the samples with an electronic potentiostat to a constant potential of −1.05 V versus a saturated calomel reference electrode. A carbon rod is used as a counter electrode. This test procedure produces a highly alkaline pH at the "X" scribe lines by the cathodic reduction of dissolved oxygen which can cause a loss of paint adhesion by chemically dissolving the phosphate coating. The smaller the amount of paint adhesion loss, the higher the resistance of the phosphate coating to dissolution in an alkaline solution; and conversely, the greater the paint adhesion loss, the lower the resistance of the coating to dissolution. Generally, the tests are conducted for a time sufficient to allow differences in performance to be detected, which for this work was 14, 16 or 17 days. This test method has been used by R. R. Wiggle, A. G. Smith, and J. V. Petrocelli to study the alkaline resistance of phosphate coatings, published in *The Journal of Paint Technology*, 1968, entitled "Paint Adhesion Failure Mechanisms on Steel in Corrosive Environments", and by A. G. Smith and R. A. Dickie to study the alkaline resistance of paint primers, published in *Industrial and Engineering Chemistry Product Research and Development*, March 1978, entitled "Adhesion Failure Mechanism of Primers."

Scab Corrosion Test

In this test, scribed test panels are coated with a very thin layer of dry kaolin clay powder, and then immersed in a 5% sodium chloride solution for 15 minutes. The samples are removed from the solution, dried at room temperature for 75 minutes, and then placed for 22.5 hours in a test chamber maintained at 49° C. and 85 to 90% relative humidity. This procedure constitutes one test cycle and is repeated each weekday, except for coating with kaolin. During weekend and holiday periods, the samples remain in the hot, humid test chamber. Hence, five test cycles represents one week, including a weekend. In this method, the kaolin coating simulates dust and dirt contamination, and serves as an agent for retaining salt solution on the normally hydrophobic paint surface. Additional details have been published in Ford Laboratory Test Method (FLTM) BI23-1 and the SAE paper by V. Hospadaruk et al, hereinbefore referenced to.

After corrosion testing the painted and phosphated F6 steel panels for the times indicated in Tables III to V, the amount of paint adhesion loss (or undercutting) in millimeters from the scribe line was determined by taping. The results for each phosphate coating in the above corrosion tests are given in Examples 17–50.

Examination of the corrosion test results shown in Table III for cobalt/zinc phosphate coatings indicates that highly improved corrosion performance was obtained when the phosphate bath and resultant coating contained at least about 65 and 15 mole percent cobalt, respectively, of the divalent cations, exclusive of iron (Example 21 compared with Examples 17–20), and no more than approximately 95 and 46 mole percent cobalt, respectively (Example 23 compared with Examples 24–26). Superior corrosion results are indicated when the bath composition was in the most preferred range of about 84 to 94 mole percent cobalt (Example 23 compared with Examples 22 and 24).

Examination of the corrosion test results shown in Table IV for magnesium/zinc phosphate coatings indicates that improved corrosion performance was obtained when the phosphate bath composition was in the preferred range of about 84 to 94 mole percent magnesium (Examples 32–35 compared with Examples 27–31 and 36–37), and that superior corrosion performance was obtained at a magnesium composition in the bath of about 93–94 mole percent (Example 35).

Also, examination of the corrosion results given in Table V for manganese/zinc phosphate coatings indicates that superior performance was obtained when the phosphate composition was in the preferred composition range of about 84–94 mole percent manganese (Examples 46–48 compared with Examples 38–45 and 49–50). An improvement in corrosion performance was obtained when the phosphate bath and resultant coating contained at least approximately 45 and 15 mole percent manganese, respectively, of the divalent cations, exclusive of iron, based on the Cathodic Delamination Tests (Example 40 compared with Examples 38–39), and no more than approximately 96 and 42 mole percent manganese, respectively (Example 48 compared with Examples 49–50).

Additional experimental work has been undertaken to demonstrate that the resistance to alkaline dissolution of a phosphate conversion coating can be significantly increased by incorporating mixtures of nickel, cobalt and zinc, or nickel, magnesium and zinc, or cobalt, magnesium and zinc, or nickel, manganese and zinc, or magnesium, manganese and zinc, or nickel, cobalt, magnesium and zinc, or nickel, magnesium, manganese and zinc in the deposited phosphate coating. As in the previous work, the sum of the divalent cations other than zinc must be at least 15.0 mole percent of the total divalent cations present, exclusive of iron.

Resistance to alkaline dissolution is one of the key attributes of a phosphate coating which determines its suitability for commercial use as a substrate for subsequently applied paint coatings. FIG. 1 illustrates the improved alkaline dissolution resistance provided over the narrow range of nickel concentrations claimed in the application. The laboratory method used to evaluate the alkaline dissolution resistance consists of immersing a preweighed, 4×4", phosphate coated steel sample in a minimum of 600 ml of a sodium hydroxide solution of pH 12.50 at an ambient temperature of approximately 75° F. for 40 minutes, removing the sample, and rinsing it with deionized water, followed by ethyl alcohol, and drying at 180° F. for one minute. The sample is cooled to room temperature and weighed again to the nearest 0.1 mg precision. The sample is then immersed in 100 ml of inhibited, 10% by weight hydrochloric acid solution for one minute to dissolve the remaining phosphate coating, rinsed with deionized water, followed by ethyl alcohol, dried at 180° F. for one minute, cooled to room temperature, and weighed to 0.1 mg precision, which is the final weight. The phosphate coating weight in mg is the difference of the initial and final weights, and the amount (in mg) of coating undissolved by the sodium hydroxide solution is the difference of the sample weight after immersion in this solution and the final weight. An index of the coating resistance to dissolution in an alkaline solution is the amount of undissolved coating divided by the coating weight, expressed as a percentage, which has been shown to correlate well with corrosion performance in a salt spray test.

Examples 51A and B through 57A and B listed in Table VI make use of alkaline dissolution resistance as a key indicator of improved phosphate coatings containing mixtures of zinc and the various divalent cations. The specific phosphate bath compositions investigated are shown for each example. The total-acid, free-acid, and acid ratio values given are after adjustment of the bath acidity by the addition of sodium hydroxide. The mole percent of the dissolved divalent cations is also shown in Table VI. For each example, the letter A corresponds to a "high" phosphate bath composition of a specific combination of divalent cations other than zinc, and the letter B corresponds to a "low" phosphate bath composition of the same divalent cations other than zinc. For these examples, 4×12" panels of the steel designated Q, described in Example 1, were spray cleaned, rinsed, phosphated, rinsed and dried as described in Examples 17–50. None of the phosphated panels were post-treated with an inhibitor rinse. A portion of selected panels was used for determination of composition and coating weight, while another portion was used for determination of alkaline dissolution resistance by the procedure described above. Results of these determinations are given for each example in Table VI.

Examination of the alkaline dissolution resistance results given in Table VI shows that the values are high when the sum of the divalent cations other than zinc exceeded 15 mole percent of the total divalent cations present, exclusive of iron (Examples 51A through 57A), and the dissolution values are low when the sum was less than 15 mole percent of the total divalent cations present, exclusive of iron (Examples 51B through 57B).

When bath formulations which exceed the upper composition limits disclosed for cations of each divalent transition metal and magnesium cations are used for phosphating metals, the resultant phosphate coatings on clean and surface carbon contaminated steel are typically very nonuniform in coating weight, streaked, spotted, and variable in color. Coating weights generally are very low, ranging from about 0.05 to 0.4 g/m$^2$ (5 to 40 mg/ft$^2$). Also, the coatings are characteristically amorphous. The corrosion performance was found to be inferior to that of coatings produced with bath formulations having the preferred bath composition range of 84 to 94 mole percent based on results obtained from scab corrosion testing which is considered representative of field corrosion of automobiles.

TABLE III

| EXAMPLE | 17 | 18 | 19 | 20 | 21 | 22 | 23 | 24 | 25 | 26 |
|---|---|---|---|---|---|---|---|---|---|---|
| Phosphating Bath | | | | | | | | | | |
| g/l $Zn(H_2PO_4)_2$ | 5.99 | 5.79 | 5.12 | 5.00 | 4.84 | 3.73 | 2.10 | 0.71 | 0.52 | 0 |
| g/l $Co(H_2PO_4)_2$ | 4.68 | 5.45 | 6.35 | 7.56 | 9.53 | 11.34 | 12.80 | 13.87 | 14.08 | 13.80 |
| g/l $H_3PO_4$ | 2.66 | 2.92 | 3.03 | 3.50 | 5.52 | 6.57 | 5.77 | 5.79 | 5.87 | 5.46 |
| g/l $NaNO_2$ | 0.08 | 0.08 | 0.08 | 0.08 | 0.08 | 0.09 | 0.08 | 0.08 | 0.09 | 0.09 |
| g/l NaF | 0.66 | 0.66 | 0.66 | 0.66 | 0.66 | 0.66 | 0.66 | 0.66 | 0.66 | 0.66 |
| Total Acid, pt. | 16.4 | 17.3 | 17.3 | 19.3 | 22.5 | 25.5 | 23.3 | 23.7 | 23.2 | 19.3 |
| Free Acid, pt. | 1.1 | 1.1 | 1.1 | 1.2 | 1.2 | 1.2 | 1.1 | 1.1 | 1.1 | 1.1 |
| Acid Ratio | 15 | 16 | 16 | 16 | 19 | 21 | 21 | 21 | 21 | 18 |
| Bath Cations | | | | | | | | | | |
| Zn, mole % | 55.5 | 50.9 | 44.0 | 39.2 | 33.1 | 24.3 | 13.8 | 4.8 | 3.4 | 0 |
| Co, mole % | 44.5 | 49.1 | 56.0 | 60.8 | 66.9 | 75.7 | 86.2 | 95.2 | 96.6 | 100 |
| Cations in Coating | | | | | | | | | | |
| Zn, mole % | 90.8 | 89.0 | 87.8 | 85.6 | 82.5 | 76.9 | 71.9 | 53.8 | 13.4 | 0 |
| Co, mole % | 9.2 | 11.0 | 12.2 | 14.4 | 17.5 | 23.1 | 28.1 | 46.2 | 86.6 | 100 |
| Coating Weight | | | | | | | | | | |
| g/m$^2$ | 2.15 | 2.82 | 1.80 | 1.34 | 1.56 | 1.56 | 1.23 | 0.40 | 0.23 | 0.31 |
| mg/ft$^2$ | 200 | 262 | 168 | 124 | 145 | 145 | 114 | 37 | 22 | 28 |
| Paint* Adhesion Loss, mm | | | | | | | | | | |
| Salt Spray Test 1000 hours | 5 | 5 | 5 | 2 | 2 | 0 | 0 | 0 | 0 | 0 |
| Cathodic Delamination Test, 16 Days | 10 | 10 | 10 | 8 | 4 | 2.5 | 1.5 | 3 | 2.5 | 2.5 |
| Scab Corrosion Test 24 cycles | 3 | 3 | 2 | 1 | 1 | 1 | 0.5 | 4.5 | 4.5 | 4.5 |

*Commercial cathodic electrocoat primer (18 μm thick) applied on phosphated F6 steel.

TABLE IV

| EXAMPLE | 27 | 28 | 29 | 30 | 31 | 32 | 33 | 34 | 35 | 36 | 37 |
|---|---|---|---|---|---|---|---|---|---|---|---|
| Phosphating Bath | | | | | | | | | | | |
| g/l $Zn(H_2PO_4)_2$ | 9.68 | 6.27 | 5.83 | 5.55 | 4.52 | 4.28 | 3.09 | 2.18 | 0.56 | 0.63 | 0 |
| g/l $Mg(H_2PO_4)_2$ | 14.10 | 12.22 | 16.53 | 19.59 | 19.50 | 21.47 | 22.82 | 23.36 | 7.10 | 24.71 | 24.97 |
| g/l $H_3PO_4$ | 1.93 | 2.68 | 2.68 | 2.16 | 1.81 | 2.34 | 2.13 | 1.93 | 2.53 | 1.89 | 2.62 |
| g/l $NaNO_2$ | 0.08 | 0.08 | 0.08 | 0.09 | 0.08 | 0.08 | 0.09 | 0.09 | 0.09 | 0.08 | 0.08 |
| g/l NaF | 0.66 | 0.66 | 0.66 | 0.66 | 0.66 | 0.66 | 0.66 | 0.66 | 0.66 | 0.66 | 0.66 |
| Total Acid, pt. | 26.1 | 21.3 | 27.5 | 30.0 | 27.5 | 29.2 | 30.0 | 29.4 | 11.1 | 29.4 | 29.0 |
| Free Acid, pt. | 1.6 | 1.5 | 1.4 | 1.6 | 1.5 | 1.4 | 1.5 | 1.4 | 1.5 | 1.4 | 1.7 |
| Acid Ratio | 16 | 14 | 20 | 19 | 18 | 21 | 20 | 21 | 7.4 | 21 | 17 |
| Bath Cations | | | | | | | | | | | |
| Zn, mole % | 36.6 | 30.2 | 22.9 | 19.3 | 16.3 | 14.4 | 10.2 | 7.3 | 6.2 | 2.1 | 0 |
| Mg, mole % | 63.4 | 69.8 | 77.1 | 80.7 | 83.7 | 85.6 | 89.8 | 92.7 | 93.8 | 97.9 | 100 |
| Cations in Coating | | | | | | | | | | | |
| Zn, mole % | 93.7 | 93.6 | 91.2 | 89.7 | 88.7 | 86.9 | 84.2 | 72.1 | 58.4 | 16.8 | 0 |
| Mg, mole % | 6.3 | 6.4 | 8.8 | 10.3 | 11.3 | 13.1 | 15.8 | 27.9 | 41.6 | 83.2 | 100 |
| Coating Weight | | | | | | | | | | | |
| g/m$^2$ | 3.07 | 1.41 | 1.59 | 1.43 | 1.16 | 0.99 | 0.73 | 0.16 | 0.32 | 0.15 | 0.06 |
| mg/ft$^2$ | 285 | 131 | 148 | 133 | 108 | 92 | 68 | 15 | 30 | 14 | 6 |
| Paint* Adhesion Loss, mm | | | | | | | | | | | |
| Salt Spray Test 800 hours | 15 | 5 | 5 | 5 | 3 | 3 | 0 | 0 | 0 | 0 | 0 |
| Cathodic Delamination Test, 14 Days | 25 | 10 | 17 | 10 | 5 | 5 | 5 | 2.5 | 2.5 | 1 | 1 |
| Scab Corrosion Test | 9 | 8 | 7 | 7 | 7 | 5 | 6 | 6 | 2.5 | 4 | 5 |

TABLE IV-continued

| EXAMPLE | 27 | 28 | 29 | 30 | 31 | 32 | 33 | 34 | 35 | 36 | 37 |
|---|---|---|---|---|---|---|---|---|---|---|---|
| 24 cycles | | | | | | | | | | | |

*Commercial cathodic electrocoat primer (18 μm thick) applied on phosphated F6 steel.

TABLE V

| EXAMPLE | 38 | 39 | 40 | 41 | 42 | 43 | 44 | 45 | 46 | 47 | 48 | 49 | 50 |
|---|---|---|---|---|---|---|---|---|---|---|---|---|---|
| Phosphating Bath | | | | | | | | | | | | | |
| g/l $Zn(H_2PO_4)_2$ | 4.20 | 3.89 | 4.01 | 3.49 | 3.57 | 3.69 | 3.53 | 3.49 | 2.42 | 1.82 | 0.71 | 0.59 | 1.15 |
| g/l $Mn(H_2PO_4)_2$ | 1.72 | 2.58 | 3.26 | 3.58 | 4.26 | 7.25 | 9.61 | 12.33 | 12.47 | 14.10 | 14.64 | 14.64 | 14.42 |
| g/l $H_3PO_4$ | 5.77 | 6.60 | 6.73 | 6.05 | 2.49 | 2.62 | 2.90 | 3.22 | 3.21 | 2.07 | 3.29 | 3.48 | 1.83 |
| g/l $NaNO_2$ | 0.08 | 0.08 | 0.08 | 0.09 | 0.09 | 0.08 | 0.08 | 0.09 | 0.08 | 0.08 | 0.09 | 0.09 | 0.08 |
| g/l NaF | 0.66 | 0.66 | 0.66 | 0.66 | 0.66 | 0.66 | 0.66 | 0.66 | 0.66 | 0.66 | 0.66 | 0.66 | 0.66 |
| Total Acid, pt. | 12.2 | 13.4 | 14.1 | 14.2 | 11.0 | 14.5 | 17.1 | 20.4 | 19.3 | 19.0 | 19.5 | 19.5 | 17.9 |
| Free Acid, pt. | 0.9 | 1.0 | 1.0 | 1.0 | 1.0 | 1.0 | 1.0 | 1.1 | 1.2 | 1.0 | 0.9 | 0.9 | 1.1 |
| Acid Ratio | 14 | 13 | 14 | 14 | 11 | 14 | 17 | 19 | 16 | 19 | 22 | 22 | 16 |
| Bath Cations | | | | | | | | | | | | | |
| Zn, mole % | 70.1 | 59.1 | 54.1 | 48.3 | 44.6 | 32.8 | 26.1 | 21.4 | 15.7 | 11.0 | 4.5 | 3.8 | 7.1 |
| Mn, mole % | 29.9 | 40.9 | 45.9 | 51.7 | 55.4 | 67.2 | 73.9 | 78.6 | 84.3 | 89.0 | 95.5 | 96.2 | 92.9 |
| Cations in Coating | | | | | | | | | | | | | |
| Zn, mole % | 91.2 | 86.7 | 84.7 | 82.8 | 81.3 | 77.1 | 73.2 | 71.7 | 69.9 | 67.2 | 58.1 | 52.7 | 47.4 |
| Mn, mole % | 8.8 | 13.3 | 15.3 | 17.2 | 18.7 | 22.9 | 26.8 | 28.3 | 30.1 | 32.8 | 41.9 | 47.3 | 52.6 |
| Coating Weight | | | | | | | | | | | | | |
| $g/m^2$ | 1.71 | 2.23 | 1.81 | 1.53 | 1.26 | 1.66 | 2.19 | 1.64 | 0.94 | 1.26 | 0.64 | 0.29 | 0.29 |
| $mg/ft^2$ | 159 | 207 | 168 | 142 | 118 | 155 | 204 | 153 | 87 | 118 | 60 | 27 | 27 |
| Paint Adhesion Loss, mm | | | | | | | | | | | | | |
| Salt Spray Test,* 300 hours | 3 | 3.5 | 3 | 4 | 4.5 | 3.5 | 3.5 | 2.5 | 1 | 1 | 1 | 0 | 0 |
| Cathodic Delamination Test,** 17 days | 5 | 9 | 2 | 1.5 | 1.5 | 2.5 | 2.5 | 2.5 | 2 | 2 | 2 | 3 | 2.5 |
| Scab Corrosion Test,** 12 cycles | — | — | — | — | 0.5 | 0.5 | 0.5 | 0.5 | 0.5 | 0.5 | 1 | 2 | 2 |

*With commercial epoxy ester-melamine resin based primer (25 μm thick) applied by spraying on phosphated F6 steel.
**With commercial cathodic electrocoat primer (18 μm thick) applied on phosphated F6 steel.

TABLE VI

| EXAMPLE | 51A | 51B | 52A | 52B | 53A | 53B | 54A | 54B | 55A | 55B | 56A | 56B | 57A | 57B |
|---|---|---|---|---|---|---|---|---|---|---|---|---|---|---|
| Phosphating Bath | | | | | | | | | | | | | | |
| g/l $Zn(H_2PO_4)_2$ | 1.90 | 4.40 | 1.88 | 4.59 | 1.95 | 3.82 | 1.86 | 4.52 | 2.42 | 4.32 | 1.23 | 4.32 | 2.46 | 4.72 |
| g/l $Ni(H_2PO_4)_2$ | 10.98 | 2.97 | 8.77 | 3.48 | — | — | 10.07 | 2.58 | — | — | 2.63 | 3.14 | 3.18 | 2.93 |
| g/l $Co(H_2PO_4)_2$ | 4.72 | 1.33 | — | — | 3.55 | 1.16 | — | — | — | — | 1.72 | 0.69 | — | — |
| g/l $Mg(H_2PO_4)_2$ | — | — | 17.37 | 3.32 | 14.28 | 2.72 | — | — | 13.75 | 5.48 | 4.04 | 3.14 | 13.57 | 2.07 |
| g/l $Mn(H_2PO_4)_2$ | — | — | — | — | — | — | 2.27 | 0.59 | 2.72 | 0.68 | — | — | 2.68 | 0.68 |
| g/l $H_3PO_4$ | 2.74 | 2.92 | 9.88 | 3.38 | 1.59 | 4.38 | 2.91 | 2.18 | 0.79 | 0.42 | 6.01 | 3.97 | 0.79 | 2.20 |
| g/l $NaNO_2$ | 0.08 | 0.08 | 0.08 | 0.08 | 0.08 | 0.08 | 0.09 | 0.08 | 0.08 | 0.09 | 0.08 | 0.08 | 0.08 | 0.10 |
| g/l NaF | 0.66 | 0.66 | 0.66 | 0.66 | 0.66 | 0.66 | — | — | — | — | 0.66 | 0.66 | — | — |
| Total Acid, pt. | 21.8 | 15.0 | 39.1 | 16.0 | 23.8 | 12.3 | 19.2 | 11.3 | 20.2 | 13.1 | 19.5 | 16.5 | 24.8 | 13.0 |
| Free Acid, pt. | 0.8 | 0.95 | 0.7 | 0.9 | 1.0 | 0.8 | 1.0 | 1.0 | 1.0 | 1.0 | 0.8 | 0.9 | 1.0 | 0.9 |
| Acid Ratio, pt. | 27 | 16 | 56 | 18 | 24 | 15 | 19 | 11 | 20 | 13 | 24 | 18 | 25 | 14 |
| Bath Cations (mole %) | | | | | | | | | | | | | | |
| Ni | 62.5 | 34.6 | 28.6 | 29.5 | — | — | 71.0 | 34.0 | — | — | 25.7 | 26.9 | 13.2 | 27.6 |
| Co | 26.9 | 15.5 | — | — | 16.1 | 14.5 | — | — | — | — | 16.8 | 5.9 | — | — |
| Mg | — | — | 65.4 | 32.6 | 75.2 | 39.2 | — | — | 75.7 | 56.4 | 45.8 | 31.1 | 65.5 | 22.6 |
| Mn | — | — | — | — | — | — | 16.2 | 7.9 | 13.1 | 6.1 | — | — | 11.3 | 6.5 |
| Sum (except Zn) | 89.4 | 50.1 | 94.0 | 62.1 | 91.3 | 53.7 | 87.2 | 41.9 | 88.8 | 62.5 | 88.3 | 63.9 | 90.0 | 56.7 |
| Zn | 10.6 | 49.9 | 6.0 | 37.9 | 8.7 | 46.3 | 12.8 | 58.1 | 11.2 | 37.5 | 11.7 | 36.1 | 10.0 | 43.3 |
| Cations in coating (mole %) | | | | | | | | | | | | | | |
| Ni | 12.3 | 2.9 | 10.0 | 3.7 | — | — | 10.4 | 2.4 | — | — | 4.8 | 3.0 | 3.9 | 2.7 |
| Co | 12.1 | 3.8 | — | — | 12.2 | 4.0 | — | — | — | — | 9.0 | 2.0 | — | — |
| Mg | — | — | 12.1 | 2.9 | 6.7 | 2.5 | — | — | 8.0 | 4.0 | 3.9 | 3.2 | 7.3 | 0.8 |
| Mn | — | — | — | — | — | — | 13.5 | 3.5 | 12.5 | 4.0 | — | — | 11.3 | 3.8 |
| Sum (except Zn) | 24.4 | 6.7 | 22.1 | 6.6 | 18.9 | 6.5 | 23.9 | 5.9 | 20.5 | 8.0 | 17.7 | 8.2 | 22.5 | 7.3 |
| Zn | 75.6 | 93.3 | 77.9 | 93.4 | 81.1 | 93.5 | 76.1 | 94.1 | 79.5 | 92.0 | 82.3 | 91.8 | 77.5 | 92.7 |
| Coating Weight | | | | | | | | | | | | | | |
| $g/m^2$ | 0.79 | 1.38 | 1.0 | 1.50 | 0.47 | 2.35 | 1.20 | 2.62 | 0.86 | 1.70 | 1.09 | 1.68 | 1.0 | 1.78 |
| $mg/ft^2$ | 73 | 128 | 96 | 137 | 44 | 218 | 111 | 243 | 80 | 158 | 101 | 156 | 96 | 165 |
| Alkaline dissolution resistance | 61 | 33 | 66 | 34 | 63 | 27 | 48 | 35 | 64 | 41 | 70 | 36 | 58 | 30 |

TABLE VI-continued

| EXAMPLE | 51A | 51B | 52A | 52B | 53A | 53B | 54A | 54B | 55A | 55B | 56A | 56B | 57A | 57B |
|---|---|---|---|---|---|---|---|---|---|---|---|---|---|---|
| index | | | | | | | | | | | | | | |

We claim:

1. A method for increasing the resistance to alkaline dissolution of a phosphate conversion coating on a corrodible metal substrate, said coating being deposited by exposing said substrate to an acidic, aqueous solution containing first and second divalent metal cations and phosphate ions, the method comprising:
   (a) selecting cobalt cations as said first divalent metal cations;
   (b) selecting zinc cations as said second divalent metal cations;
   (c) maintaining a minimum zinc ion concentration in said solution of 0.2 grams per liter; and
   (d) controlling the concentrations of said first and said second divalent metal cations in said solution so that the concentration of said cobalt cations is maintained at the time of coating between about 65 and about 95 mole percent of the total first and second divalent metal cations in said solution.

2. A method in accordance with claim 1, wherein the concentration of said cobalt cations in said solution at the time of coating is maintained between about 75 and 94 mole percent of the total first and second divalent metal cations in said solution.

3. A method in accordance with claim 2, wherein the concentration of said cobalt cations in said solution at the time of coating is maintained between about 84 and 94 mole percent of the total first and second divalent metal cations in said solution.

4. A corrosion resistant coated metal object prepared by the method of claim 1.

5. A method for increasing the resistance to alkaline dissolution of a phosphate conversion coating on a corrodible metal substrate, said coating being deposited by exposing said substrate to an acidic, aqueous solution containing first and second divalent metal cations and phosphate ions, the method comprising:
   (a) selecting cobalt cations as said first divalent metal cations;
   (b) selecting zinc cations as said second divalent metal cations;
   (c) maintaining a minimum zinc ion concentration in said solution of 0.2 grams per liter;
   (d) controlling the concentrations of said first and said second divalent metal cations in said solution so that the concentration of said cobalt cations is maintained at the time of coating between about 65 and about 95 mole percent of the total first and second divalent metal cations in said solution; and
   (e) maintaining the total acid content of said solution in the range of 10 to 40 points, maintaining the free acid content of said solution in the range of 0.5 to 2.0 points and maintaining the total acid to free acid ratio in said solution in the range of 10 to 60.

6. A method in accordance with claim 5, wherein the concentration of said cobalt cations in said solution at the time of coating is maintained between about 75 and 94 mole percent of the total first and second divalent metal cations in said solution.

7. A method in accordance with claim 6, wherein the concentration of said cobalt cations in said solution at the time of coating is maintained between about 84 and 94 mole percent of the total first and second divalent metal cations in said solution.

8. A corrosion resistant coated metal object prepared by the method of claim 5.

9. A corrosion-resistant, coated metal object having a metal substrate and a continuous phosphate conversion coating deposited thereon comprising a mixed metal phosphate containing at least one first divalent metal element and a second divalent metal element, the cations of which are chemically combined with phosphate ions, wherein said coating is further characterized in that:
   (a) about 15.0 to about 43.0 mole percent of the total first and second divalent metal cations in the deposited coating are first divalent metal cations consisting essentially of cobalt cations;
   (b) the second divalent metal element is zinc; and
   (c) about 85.0 to about 57.0 mole percent of the total first and second divalent metal cations in the deposited coating are zinc cations.

10. A corrosion-resistant, coated metal object having a metal substrate and a continuous phosphate conversion coating deposited thereon comprising a mixed metal phosphate containing zinc and at least one first divalent metal element, the cations of which are chemically combined with phosphate ions, wherein said coating is further characterized that:
   (a) about 15.0 to about 43.0 mole percent of the total zinc/first divalent metal cations in the deposited coating, exclusive of incidental cations from the substrate, are first divalent metal cations consisting essentially of cobalt cations; and
   (b) the remainder of divalent metal cations in the deposited coating is comprised predominantly of zinc cations.

11. An aqueous concentrate for use in an aqueous solution for depositing a zinc phosphate conversion coating comprising water, phosphate ions, zinc cations and cobalt cations and further characterized in that said concentrate contains said cobalt cations and said zinc cations in the mole ratio range of about 5.2:1 to about 16:1 and said zinc cations are present in a concentration in excess of 0.2 grams per liter.

12. An aqueous concentrate in accordance with claim 11, wherein a portion of said phosphate ions are replaced with nitrate ions.

13. An aqueous concentrate in accordance with claim 11, wherein a portion of said phosphate ions are replaced with nitrate ions.

* * * * *